US009853358B2

(12) United States Patent
Wu et al.

(10) Patent No.: US 9,853,358 B2
(45) Date of Patent: Dec. 26, 2017

(54) AIR-FILLED PATCH ANTENNA

(71) Applicant: The Chinese University of Hong Kong, Hong Kong (CN)

(72) Inventors: Ke-Li Wu, Hong Kong (CN); Zhen-Yuan Zhang, Chang Zhou (CN); Dacheng Wei, Guang Zhou (CN)

(73) Assignee: THE CHINESE UNIVERSITY OF HONG KONG, Hong Kong (CN)

( * ) Notice: Subject to any disclaimer, the term of this patent is extended or adjusted under 35 U.S.C. 154(b) by 0 days.

(21) Appl. No.: 14/836,303

(22) Filed: Aug. 26, 2015

(65) Prior Publication Data

US 2017/0062933 A1 Mar. 2, 2017

(51) Int. Cl.
*H01Q 9/04* (2006.01)

(52) U.S. Cl.
CPC ..... *H01Q 9/0407* (2013.01)

(58) Field of Classification Search
CPC ..... H01Q 9/0407–9/0478
See application file for complete search history.

(56) References Cited

U.S. PATENT DOCUMENTS 5,734,350 A * 3/1998 Deming ..... H01Q 1/42 343/700 MS
6,369,761 B1 * 4/2002 Thiam ..... H01Q 1/243 343/700 MS
7,119,746 B2 * 10/2006 Luk ..... H01Q 9/36 343/700 MS

* cited by examiner

*Primary Examiner* — Tho G Phan
*Assistant Examiner* — Patrick Holecek
(74) *Attorney, Agent, or Firm* — Seed IP Law Group LLP

(57) ABSTRACT

Disclosed is an air-filled patch antenna, comprising: a ground plane; a patch arranged to be in parallel to the ground plane; four inherent metal legs extending from the patch perpendicularly, wherein each of distal ends of the four legs is electrically and mechanically connected to the ground plane; and a feeding structure configured to provide a signal interface to the antenna.

15 Claims, 29 Drawing Sheets

AIR-FILLED PATCH ANTENNA

BACKGROUND

Technical Field

This application relates to the field of antennas, in particular, to circularly polarized or dual polarized antennas in the form of air-filled patch antennas.

Description of the Related Art

Since circularly polarized (CP) and dual polarized antennas are able to receive EM wave with an arbitrarily oriented linear polarization, they have been widely used in many applications such as RFID (Radio Frequency Identification) readers, GPS (Global Positioning System) and satellite communication systems. Dual polarized antennas can independently receive and transmit electromagnetic waves polarized in two orthogonal directions. The two polarized electromagnetic waves can carry two independent signals. Therefore, they are widely used in wireless base stations.

Taking the advantages of low profile and light weight, the patch antenna is one of the most popularly used antennas. A CP patch antenna can be easily realized by printing a metal patch on a piece of grounded dielectric substrate. To reduce the dielectric loss, to improve radiation efficiency and to cut the manufacturing cost, air-filled CP and dual polarized patch antennas are frequently used by supporting the metal patch with dielectric posts. Such dielectric supporters inevitably incur extra losses, cost and inconvenience in installation for mass production. Another widely used CP antenna is the slot antennas with metal cavities, among which CP antennas can be created by various slot arrangements. Usually, the metal cavities usually expensive to make and is very bulky. CP dielectric resonator antenna (DRA) is also a kind of well-known CP antennas. With the high permittivity of the dielectric, the volume of the antenna can be greatly reduced. However, the price for low-loss dielectric is usually very expensive. For many practical applications, it is desirable to have a type of CP or dual polarized antennas that are of low profile, low cost, light weight, and convenient to make.

BRIEF SUMMARY

According to an aspect of the present application, a patch antenna comprises a ground plane; a patch arranged to be in parallel to the ground plane; four inherent metal legs extending from four legitimate locations of the patch perpendicularly, wherein each of distal ends of the four legs is electrically and mechanically connected to the ground plane; and a feeding structure configured to provide a signal interface to the antenna.

According to embodiments, the patch may be in rectangular shape. For a CP antenna, the feeding structure is arranged to feed the patch at a feeding position along a diagonal line of the patch. The feeding position may be close to one of the legs. The feeding structure may be a probe.

According to embodiments, a cross-shaped slot may be cut through the rectangular patch, wherein an intersection of the slot is located in the center of the patch, and two lines of the slot are in parallel to the two adjacent sides of the rectangular patch, respectively. For a CP antenna, the feeding structure is arranged to feed the patch at a feeding position along a diagonal line of the patch. The feeding position may be close to one of the legs. The feeding structure may be a probe.

According to embodiments, for a CP antenna, the feeding structure may comprise a power divider located on the grounded substrate, two transmission lines connected to and extending from the power divider, and two n-shaped probes each of which has an end connected to one of the two transmission lines and the other end is soldered to a non-grounded soldering pad on the grounded substrate. The two transmission lines may have a phase difference of 90 degrees.

According to embodiments, the patch may be in a shape of a rectangular ring. Two isosceles triangular corners may be inserted on a diagonal line of the patch respectively so that two miter corners of the patch are formed. For a CP antenna, the feeding structure may be arranged along the diagonal line at a position in or close to one of the two miter corners. The rectangular ring may be continuous.

According to embodiments, the rectangular ring may be formed by four L-shaped strips, each two of which are partially overlapped to form a side of the ring. An isosceles triangular corner may be inserted on a diagonal line of the patch so that a miter corner is formed in one of the L-shaped strips. The feeding structure for a CP antenna may be arranged along the diagonal line at a position in or close to the miter corner.

BRIEF DESCRIPTION OF THE SEVERAL VIEWS OF THE DRAWINGS

FIG. 20(*b*) illustrates the measured radiation patterns of the wideband CP antenna according to the third embodiment at different frequencies.

FIG. 21(*b*) illustrates the measured axial ratio of the wideband CP antenna according to the third embodiment at different frequencies

FIG. 32(*b*) shows feeding arrangements for the antenna of FIG. 32(*a*).

FIG. 33(*b*) shows feeding arrangements for the antenna of FIG. 33(*a*).

DETAILED DESCRIPTION

According to the present application, a patch antenna comprising a metal patch with four inherent metal legs is proposed. In particular, the antenna comprises a ground plane; a metal patch of certain shape arranged to be in parallel to the ground plane; four legs extending from the patch perpendicularly, wherein each of distal ends of the four legs is fixed to the ground plane; and a feeding structure.

The application is proposed based on the following principle. For a given enclosure condition, the electromagnetic fields resonate at discrete frequencies. At each of such frequencies, the corresponding intrinsic distribution of the electromagnetic fields is called a mode. A patch antenna provides a kind of enclosure condition, and different patch configuration creates different possible modes. For a given patch configuration, the voltage distribution that is proportional to the strength distribution of the perpendicularly polarized electric field underneath the patch is unique. The patch antenna configuration proposed in this disclosure supports a kind of two orthogonal degenerate modes operating at the same or much closed frequencies, whose voltage distribution presents four voltage nulls on the edge of the patch. According to the present application, the four shorting legs are placed at the locations of voltage nulls. The two orthogonal degenerate modes can be used to create a circularly polarized patch antenna or a dual linear polarized antenna.

Some embodiments are provided below.

Embodiment 1

Figure 1:
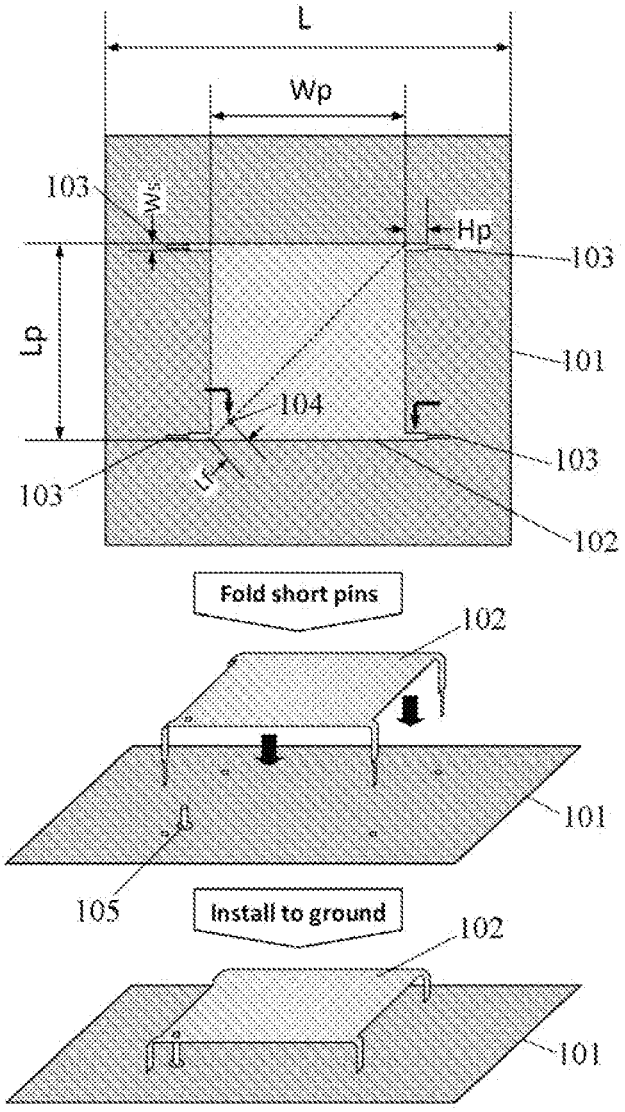
FIG. 1 illustrates a CP antenna according to an embodiment of the present application.

FIG. 1 illustrates a CP antenna according to an embodiment of the present application. As shown, the CP antenna comprises aground plane 101; a patch 102 of a certain shape arranged to be in parallel to the ground plane 101; four legs 103 extending from the patch perpendicularly, wherein each of distal ends of the four legs 103 is fixed to the ground plane 101; and a feeding structure. The feeding structure is arranged to feed the patch at a position 104 along a diagonal line of the patch 102 and close to one of the legs 103. The feeding structure may be a probe 105.

As shown, a table-like air patch (TAP) CP antenna with four inherent metal legs is invented. The four legs are arranged at positions at which the voltage is equal to zero. The length and width of the rectangular patch are Lp and Wp, respectively. Four metal legs construct four shorting pins at the four corners of the patch with the height of Hp and thin width of Ws. The four legs provide a reliable mechanical support to the rectangular 'table' in the air. A finite ground plane with size of L by L is assumed, but the actual size is not critical in a practical design. The TAP CP antenna can be fed by a probe located along the diagonal line of the patch and Lf distance away from one of the legs. For a wide band TAP CP antenna, the height Hp of the patch is relative larger. A wideband TAP CP antenna will be discussed later.

To investigate the resonant modes in the TAP CP antenna, the electric field distributions underneath the patch are calculated using a 3D EM simulator. From the obtained total electric field at 0° and 90° phase states, respectively, it can be observed that there are two orthogonal $TM_{110}$ resonant modes in the semi-open patch resonator. The phases of the two modes are offset by 90°, which provides the required phase condition for a CP antenna.

Figure 2A:
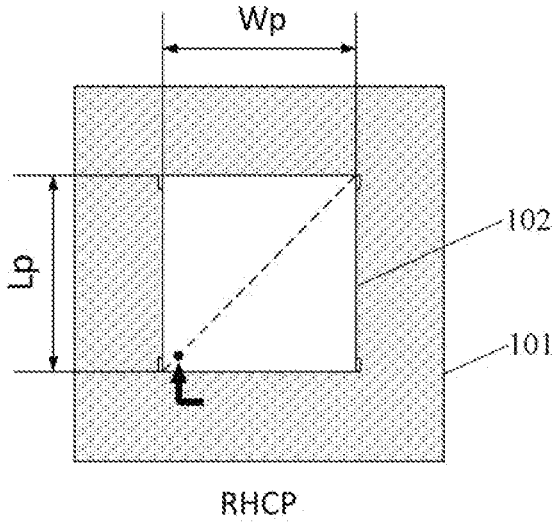
FIGS. 2(*a*) and 2(*b*) show feeding arrangements for right-hand circularly polarization (RHCP) and left-hand circularly polarization (LHCP) configurations of the antenna of FIG. 1.
Figure 2B:
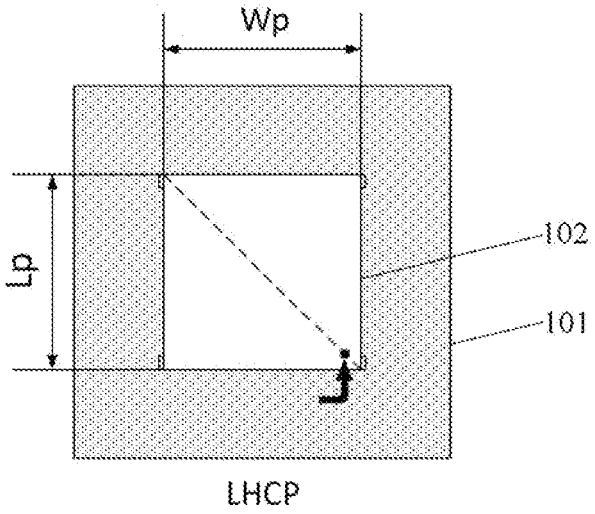

FIGS. 2(*a*) and 2(*b*) show the feeding arrangements for the right-hand (RHCP) and left-hand (LHCP) TAP CP antennas fed by a probe, respectively. It can be seen that a LHCP TAP CP antenna is a mirror counterpart of a RHCP TAP CP antenna. The value of Lp should be larger than that of Wp in FIGS. 2(*a*) and 2(*b*). The feeding positions in the RHCP and LHCP TAP CP antennas are indicated by arrows in FIGS. 2(*a*) and 2(*b*), respectively.

The dimensions of the antenna may be designed based on simulations with EM software. According to one or more desired parameters, such as the reflection coefficient, peak gain and axial ratio, dimensions of the antenna may be adjusted. Among the dimensions of the antenna, lateral dimensions for the antenna are selected so that the antenna works at a right frequency, at which the antenna's gain and axial ratio reach to optimal. In addition, the feeding position is selected so that a low reflection coefficient is achieved for a good impedance matching.

For example, a TAP CP antenna with the physical dimensions listed in Table I shows good performance.

TABLE I

| | L | Lp | Wp | Ws | Lf | Hp |
|---|---|---|---|---|---|---|
| mm | 200 | 73.5 | 67 | 1 | 4.5 | 4 |
| $\lambda_o$ | 1.633 | 0.6 | 0.547 | 0.008 | 0.037 | 0.033 |

Figure 10:
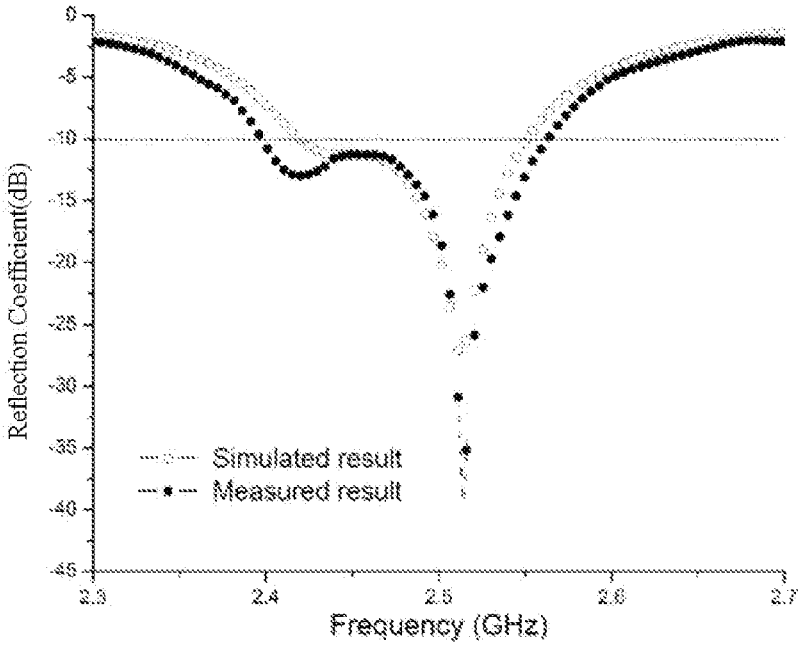
FIG. 10 illustrates the simulated and measured reflection coefficient of a CP antenna according to the first embodiment.
Figure 11:
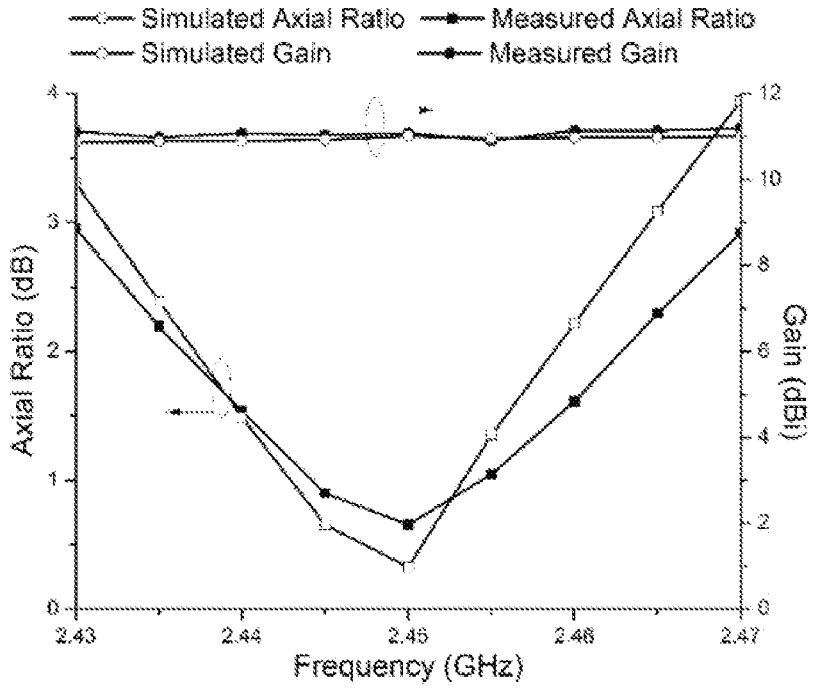
FIG. 11 illustrates the simulated and measured peak gain and axial ratio versus frequency of the CP antenna according to the first embodiment.
Figure 12:
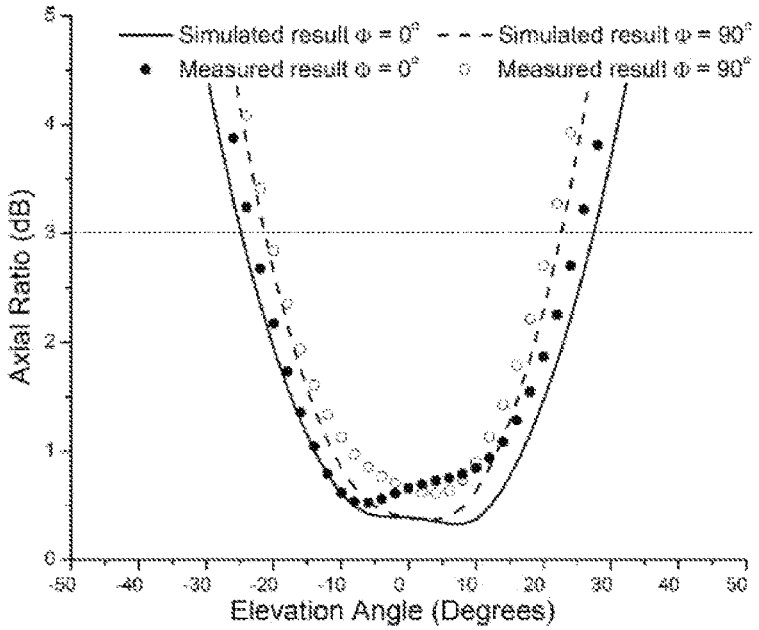
FIG. 12 illustrates axial ratio versus elevation angles of the CP antenna measured at 2.45 GHz according to the first embodiment.
Figure 13A:
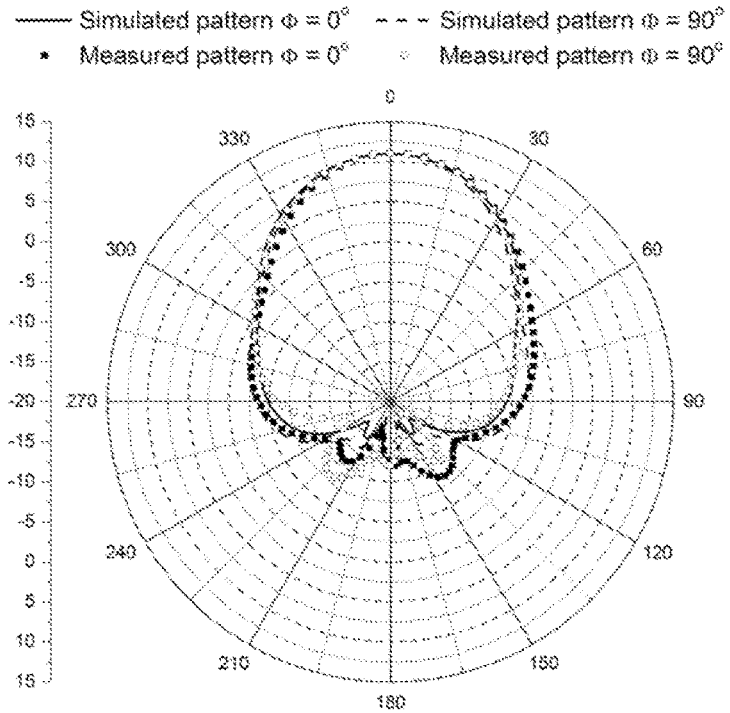
FIGS. 13(*a*), 13(*b*) and 13(*c*) illustrate radiation patterns of the RHCP CP antenna at 2.45 GHz according to the first embodiment.
Figure 13B:
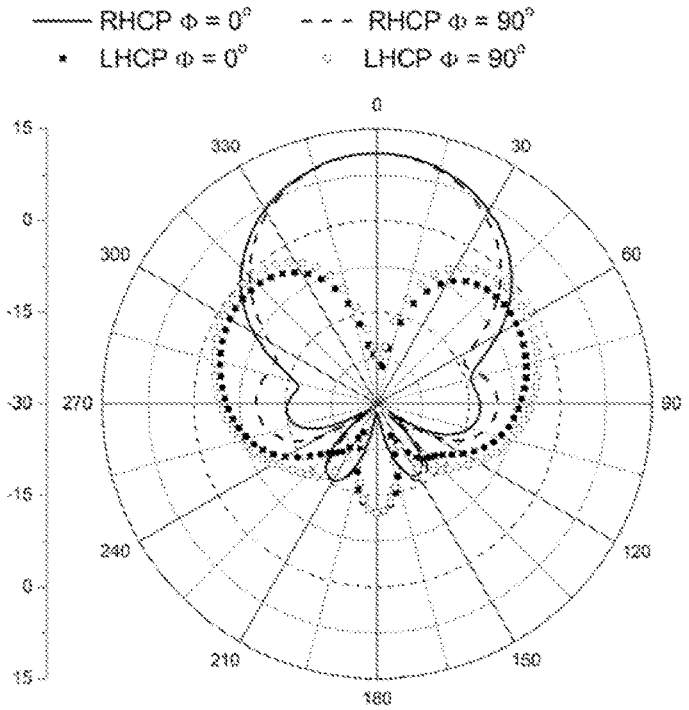
Figure 13C:
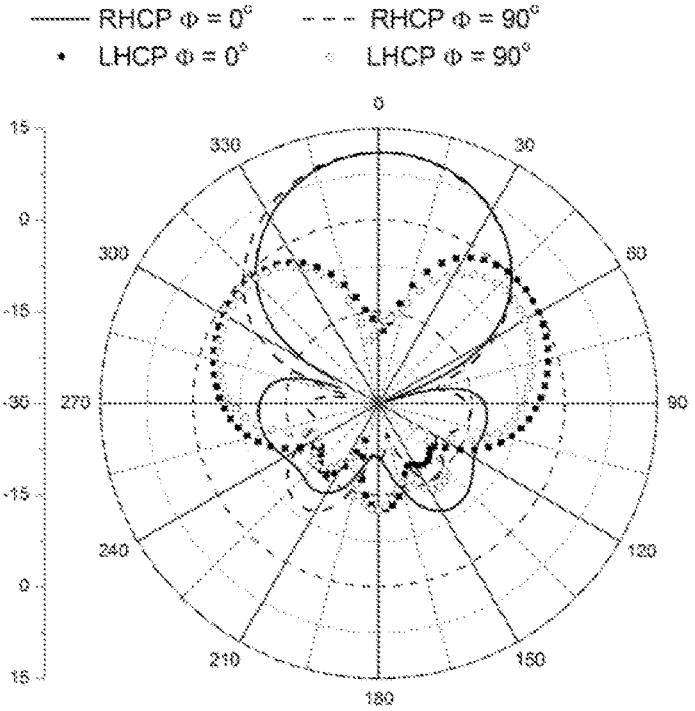

FIG. 10 illustrates the simulated and measured reflection coefficients of a TAP CP antenna according to the embodiment with the above parameters. As can be seen, the bandwidth of the antenna spans from 2.38 GHz to 2.55 GHz with reflection coefficient less than −10 dB. FIG. 11 illustrates the simulated and measured peak gain and axial ratio versus frequency of the TAP CP antenna. The simulated peak gain over the operational bandwidth is about 11.3 dBi, while the measured gain is about 11.1 dBi. The axial ratio bandwidth below 3 dB is found from 2.43 GHz to 2.47 GHz, which falls in the matched impedance frequency range. FIG. 12 illustrates axial ratio versus elevation angles of the TAP CP antenna measured at 2.45 GHz. FIGS. 13(*a*), 13(*b*) and 13(*c*) illustrate radiation patterns of the RHCP TAP CP antenna at 2.45 GHz, wherein FIG. 13(*a*) shows the total gain, FIG. 13 (*b*) shows the simulated results for RHCP and LHCP patterns, and FIG. 13(*c*) shows the measured results for RHCP and LHCP patterns. As shown, the simulated and measured results demonstrate that the proposed TAP CP antenna has a good radiation performance for circular polarization applications.

Embodiment II

Figure 3:
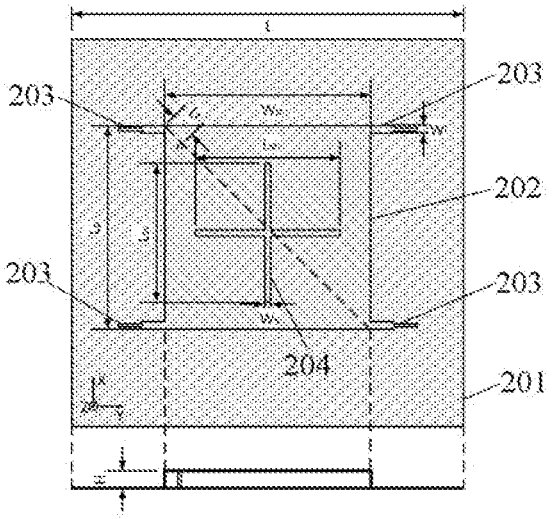
FIG. 3 illustrates a CP antenna according to an embodiment of the present application.
Figure 3:
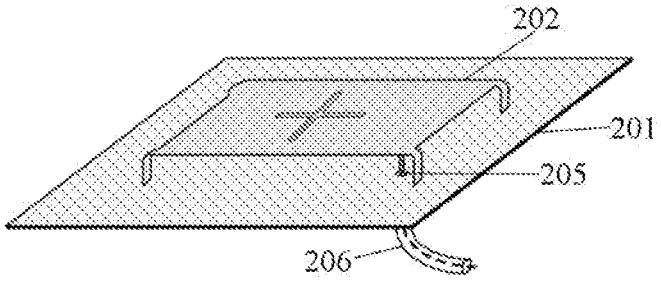

FIG. 3 illustrates a CP antenna according to an embodiment of the present application. As compared with the CP antenna of FIG. 1, the ground 201, the patch 202 and the legs 203 in Embodiment II are similar with the ground 101, the patch 102 and the legs 103 in Embodiment I, except that the CP antenna according to the Embodiment II further comprises a cross-shaped slot 204 at the center of the patch 202. As shown in FIG. 3, the two slots are in parallel to the two adjacent sides of the patch, respectively. As shown, a feeding probe 205 connected with a cable 206 is located along the diagonal line of the patch and Lf distance away from one of the legs.

The cross-slot TAP CP antenna proposed in Embodiment II is a size-reduced version of the TAP CP antenna as compared to that proposed in Embodiment I. The size and radiation performance of the cross-slot TAP CP antenna are comparable to the traditional CP air patch antenna. Similar to a TAP CP antenna, a cross-slot TAP CP antenna consists of a slot-cut rectangular patch with four metallic legs at the corners of the patch mounted on a conductive ground plane, where the length and width of the rectangular patch are Lp and Wp, respectively. A cross-shaped slot is cut on the top patch, of which the horizontal and vertical lengths are Lsh and Lsv, respectively. The width of the cross-shaped slot is Ws, which is not very critical to the radiation performance of the antenna. Four metallic legs with the height of H and thin width of W1 provide stable mechanical support to the patch. The cross-slot TAP CP antenna can be fed by a probe located along the diagonal line of the patch and Lf distance away from one of the legs.

Figure 4A:
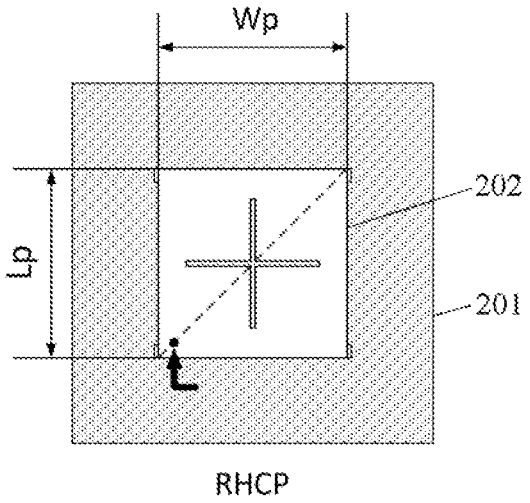
FIGS. 4(*a*) and 4(*b*) show feeding arrangements for right-hand (RHCP) and left-hand (LHCP) configurations of the antenna of FIG. 3.
Figure 4B:
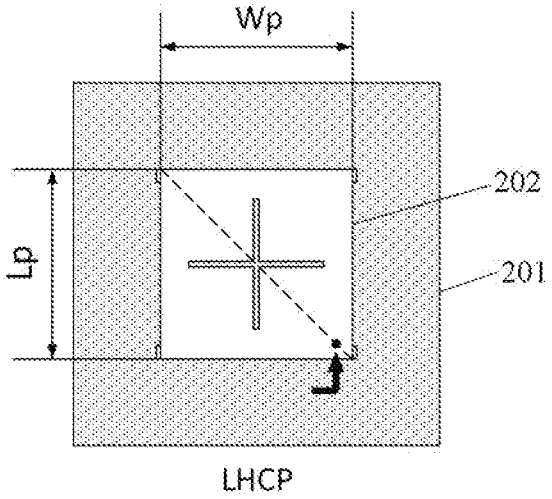

FIGS. 4(*a*) and 4(*b*) show the feeding point arrangements for a LHCP antenna and a RHCP antenna, respectively, where the value of Lp should be larger than that of Wp. Actually, the difference between the LHCP and RHCP antennas is that the feeding probe is located on the corresponding location along the different diagonals of the patch. The feeding positions in the RHCP and LHCP cross-slot TAP CP antennas are indicated by arrows in FIGS. 4(*a*) and 4(*b*), respectively.

For example, across-slot TAP CP antenna with the physical dimensions listed in Table II shows good performance.

TABLE II

| | L | Lp | Wp | Lsv | Lsh | Ws | Lf | H | Wl |
|---|---|---|---|---|---|---|---|---|---|
| mm | 350 | 59.5 | 57 | 41.2 | 42 | 1 | 1.95 | 4 | 1 |
| $\lambda_o$ | 2.859 | 0.486 | 0.482 | 0.348 | 0.355 | 0.008 | 0.016 | 0.034 | 0.008 |

It is understood that the dimensions of the antenna may be designed based on simulations with EM software. Dimensions of the antenna may be adjusted so that one or more desired parameters, such as reflection coefficient, peak gain and axial ratio, are obtained.

Figure 14:
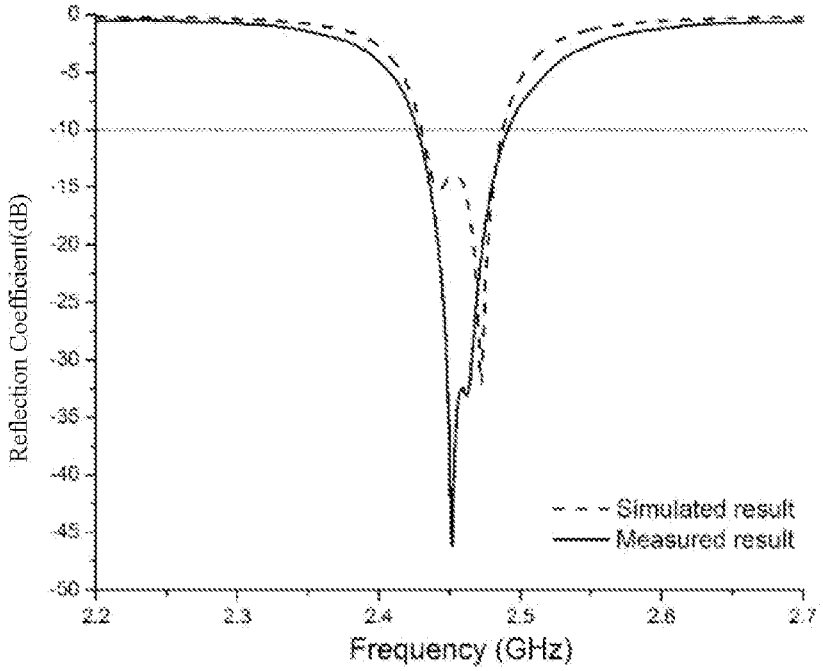
FIG. 14 illustrates the simulated and measured reflection coefficients of a cross-slot CP antenna according to the second embodiment.
Figure 15:
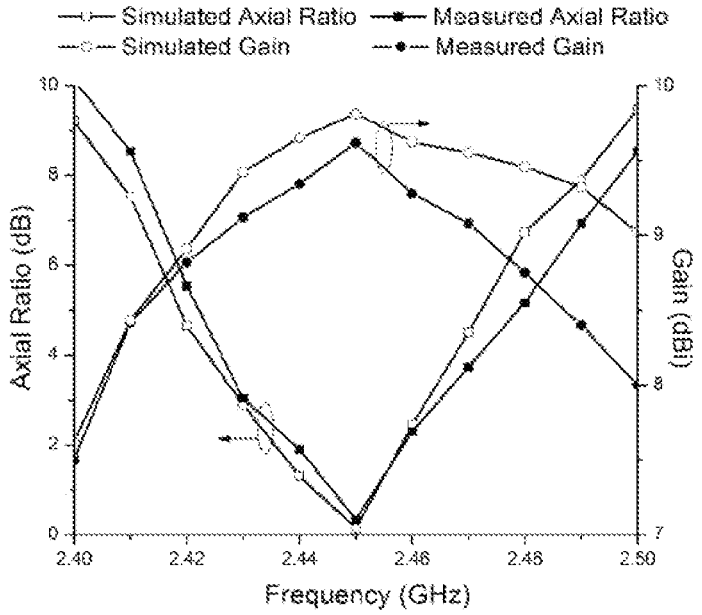
FIG. 15 illustrates the simulated and measured peak gain and axial ratio versus frequency of the cross-slot CP antenna according to the second embodiment.
Figure 16:
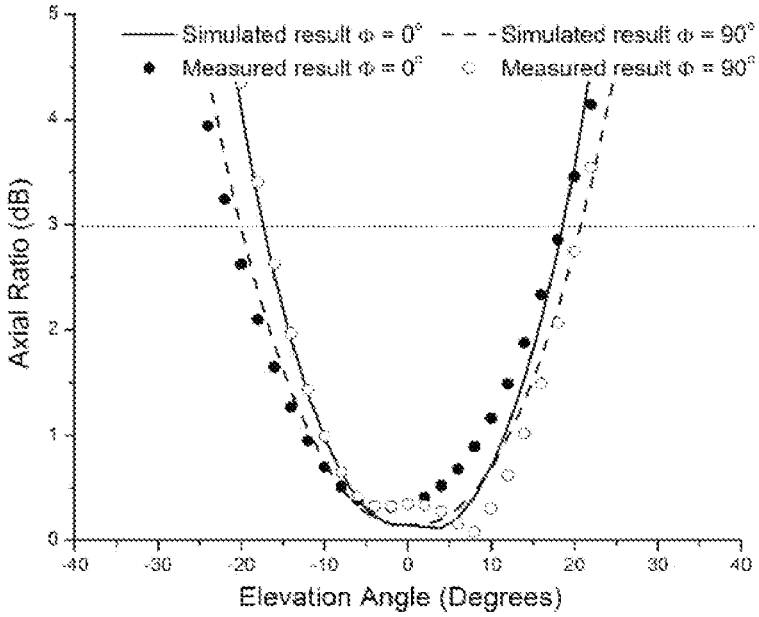
FIG. 16 illustrates the axial ratio versus elevation angles measured at 2.45 GHz according to the second embodiment.
Figure 17A:
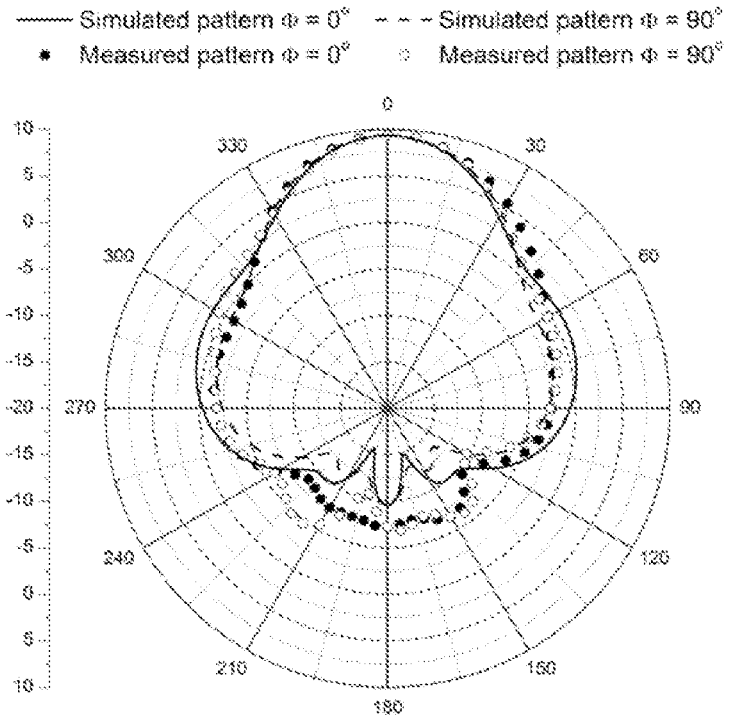
FIGS. 17(*a*), 17(*b*) and 17(*c*) illustrate radiation patterns of the cross-slot LHCPCP antenna at 2.45 GHz according to the second embodiment.
Figure 17B:
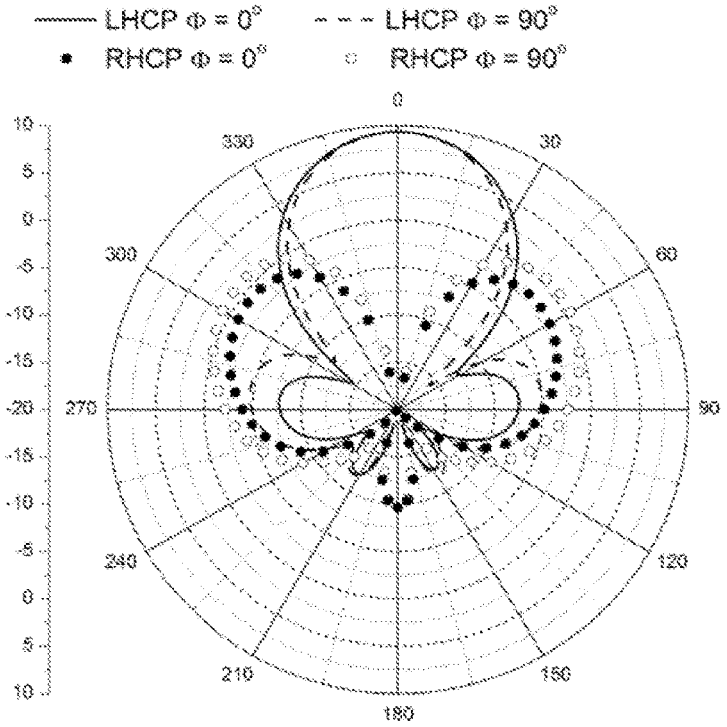
Figure 17C:
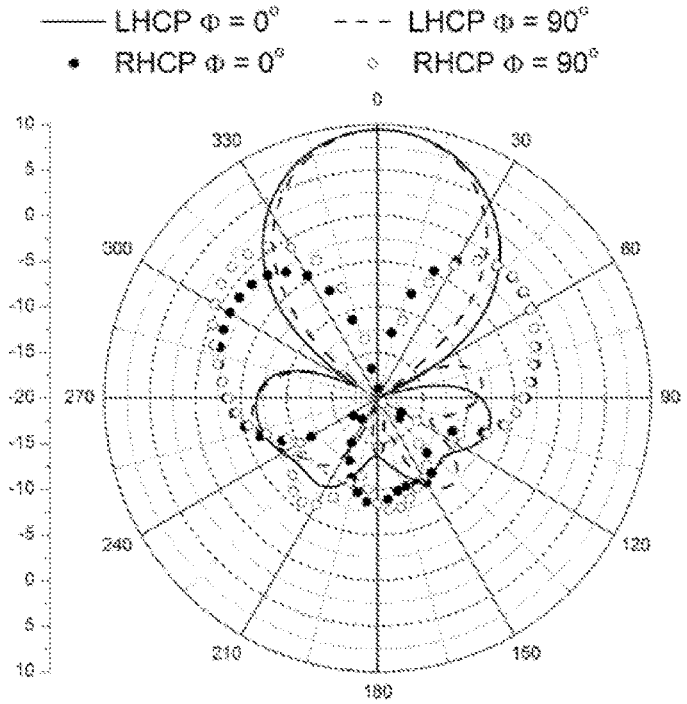

FIG. 14 illustrates the simulated and measured coefficient coefficients of a cross-slot TAP CP antenna according to the embodiment with the above parameters. FIG. 15 illustrates the simulated and measured peak gain and axial ratio versus frequency of the cross-slot CP-TAP antenna. FIG. 16 illustrates the axial ratio versus elevation angles measured at 2.45 GHz. FIGS. 17(*a*), 17(*b*) and 17(*c*) illustrate radiation patterns of the cross-slot TAP LHCP antenna at 2.45 GHz, wherein FIG. 17(*a*) shows the total gain, FIG. 17(*b*) shows the simulated results for RHCP and LHCP patterns, and FIG. 17(*c*) shows the measured results for RHCP and LHCP patterns.

Embodiment III

Figure 5A:
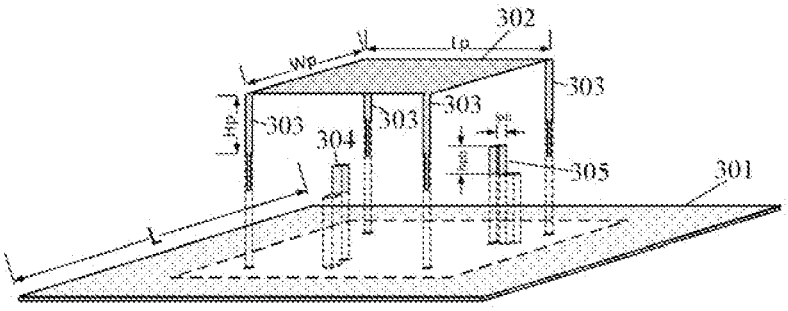
FIGS. 5(*a*), 5(*b*) and 5(*c*) illustrate a CP antenna according to an embodiment of the present application.
Figure 5B:
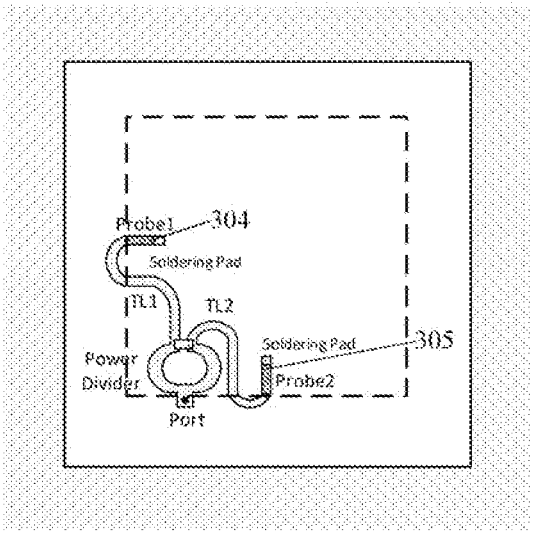
Figure 5C:
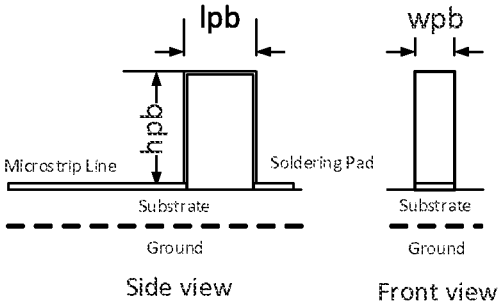

FIGS. 5(*a*)-5(*c*) illustrate a wideband CP antenna according to an embodiment of the present application. The ground 301, the patch 302 and the legs 303 in Embodiment III are similar with the ground 101, the patch 102 and the legs 103 in Embodiment I. As compared to the CP antenna proposed in Embodiment I, a different feeding structure is used in the antenna proposed in Embodiment III, which includes two probes 304 and 305. In particular, FIG. 5(*a*) shows the configuration of the wideband TAP CP antenna; FIG. 5(*b*) shows the feeding structure of the antenna; FIG. 5(*c*) shows the n-shaped probe.

As shown in FIG. 5(*b*), the feeding structure comprises a power divider (e.g., Wilkinson power divider) located on the grounded substrate, two transmission lines connected to and extending from the power divider, and two n-shaped probes 304 and 305 each of which has an end connected to one of the two transmission lines and has its other end vertically connected to a soldering pad on the substrate. The height of each of the two n-shaped probes is less than a distance between the patch and the ground. The two transmission lines have a phase difference of 90 degrees.

As shown, the ground substrate is with the dimension of L. Actually, the performance of the antenna is not very sensitive to the dimension of the ground. The upper structure is a typical TAP antenna, whose length and width are Lp and Wp, respectively. The patch is mechanically supported by four metallic legs with the length of Hp and the width of Ws. Comparing with the TAP CP antenna, the operating frequency bandwidth of such TAPCP antenna is much wider. The type of the circular polarization (RHCP or LHCP) is determined by the phase difference of the two pieces of the transmission lines. If the electric length of TL1 is longer than TL2 by 90 degrees, the polarization should be RHCP. The n-shaped probe is an approximate open-circuit quarter-wavelength resonator. The total length (2hpd+lpd) of the probe approximately equals to the quarter wavelength of the center frequency of the operating band. The open end of the n-shaped probe is mounted on a soldering pad, which provides stable mechanical support to the feeding probe. The feeding probe is folded in an "n" shape and mounted on the substrate. Thus, it eliminates the soldering of a probe to the patch, minimizes the frequency dispersion caused by the inductance of the probe that limits the antenna bandwidth, and increases the mechanical strength of the probe itself.

The dimensions of the antenna may be designed based on simulations with EM software. Specific dimensions of the antenna may be adjusted so that one or more desired parameters, such as the reflection coefficient, peak gain and axial ratio, are obtained.

For example, a wideband TAP CP antenna with the physical dimensions listed in Table III shows good performance.

TABLE III

| | L | $L_p$ | $W_p$ | $H_p$ | $W_s$ | $l_{pb}$ | $h_{pb}$ | $w_{pb}$ |
|---|---|---|---|---|---|---|---|---|
| mm | 200 | 63 | 62 | 15 | 1 | 6.5 | 12 | 2 |
| $\lambda_o$ | 1.633 | 0.52 | 0.51 | 0.124 | 0.008 | 0.053 | 0.098 | 0.017 |

Figure 18:
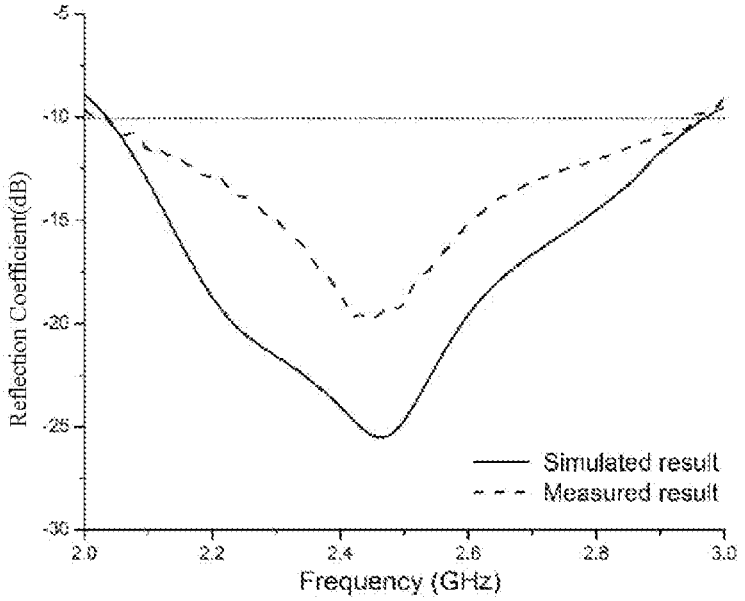
FIG. 18 illustrates the simulated and measured reflection coefficients of a wideband CP antenna according to the third embodiment.
Figure 19:
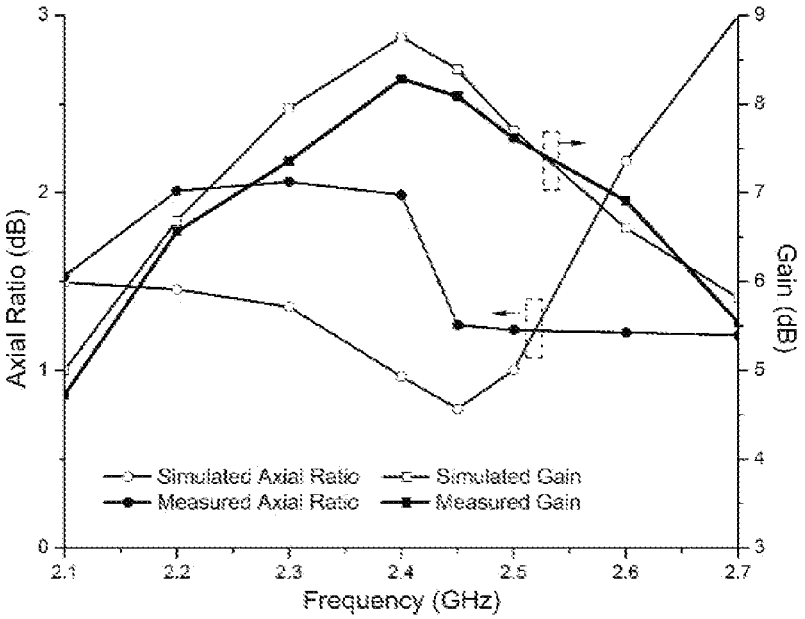
FIG. 19 illustrates the simulated and measured peak gain and axial ratio versus frequency of the wideband CP antenna according to the third embodiment.
Figure 20A:
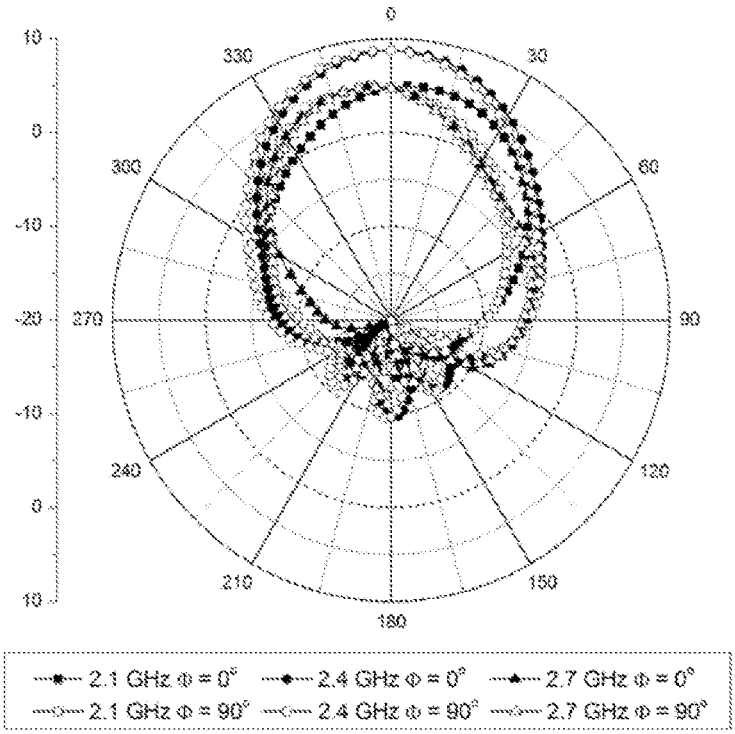
FIG. 20(*a*) illustrates the simulated radiation patterns of the wideband CP antenna according to the third embodiment at different frequencies.
Figure 20B:
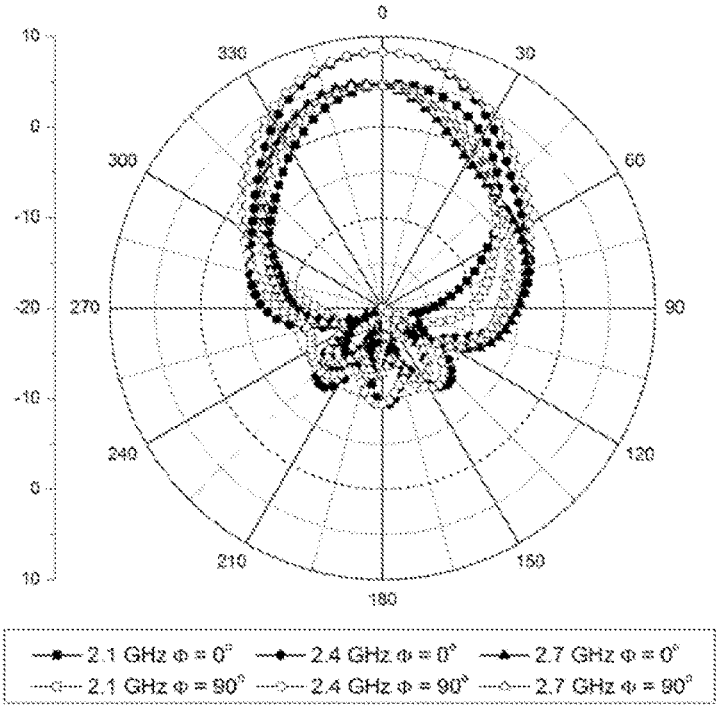
Figure 21A:
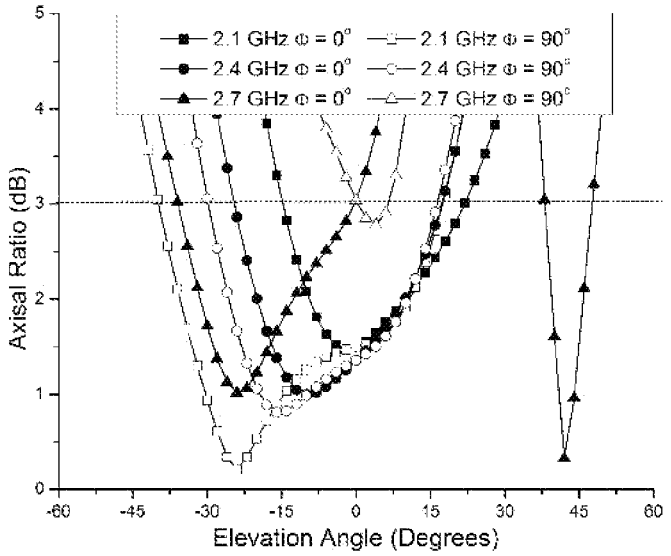
FIG. 21(*a*) illustrates the simulated axial ratio of the wideband CP antenna according to the third embodiment at different frequencies.
Figure 21B:
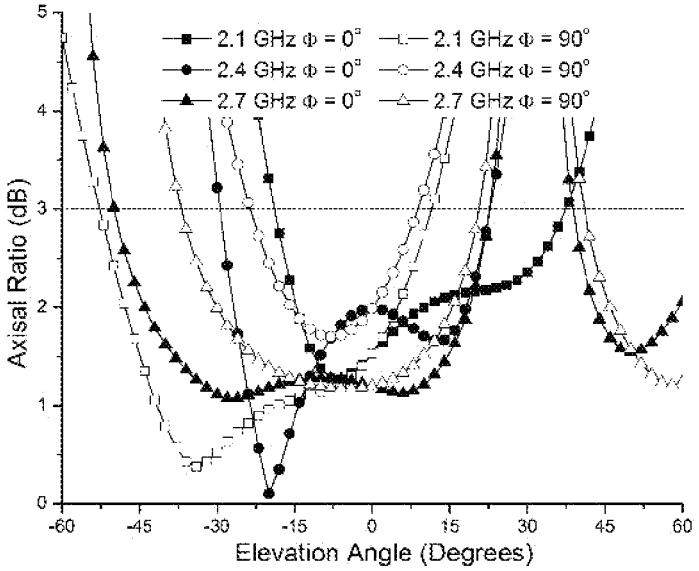

FIG. 18 illustrates the simulated and measured reflection coefficients of a wide band TAP CP antenna according to the embodiment with the above parameters. FIG. 19 illustrates the simulated and measured peak gain and axial ratio versus frequency of the wideband TAP CP antenna. FIG. 20(*a*) illustrates the simulated radiation patterns of the wideband TAP CP antenna at different frequencies; and FIG. 20(*b*) illustrates the measured radiation patterns of the wideband TAP CP antenna at different frequencies. FIG. 21(*a*) illustrates the simulated axial ratio of the wideband TAP CP antenna at different frequencies; FIG. 21(*b*) illustrates the measured axial ratio of the wideband TAP CP antenna at different frequencies.

Embodiment IV

Figure 6:
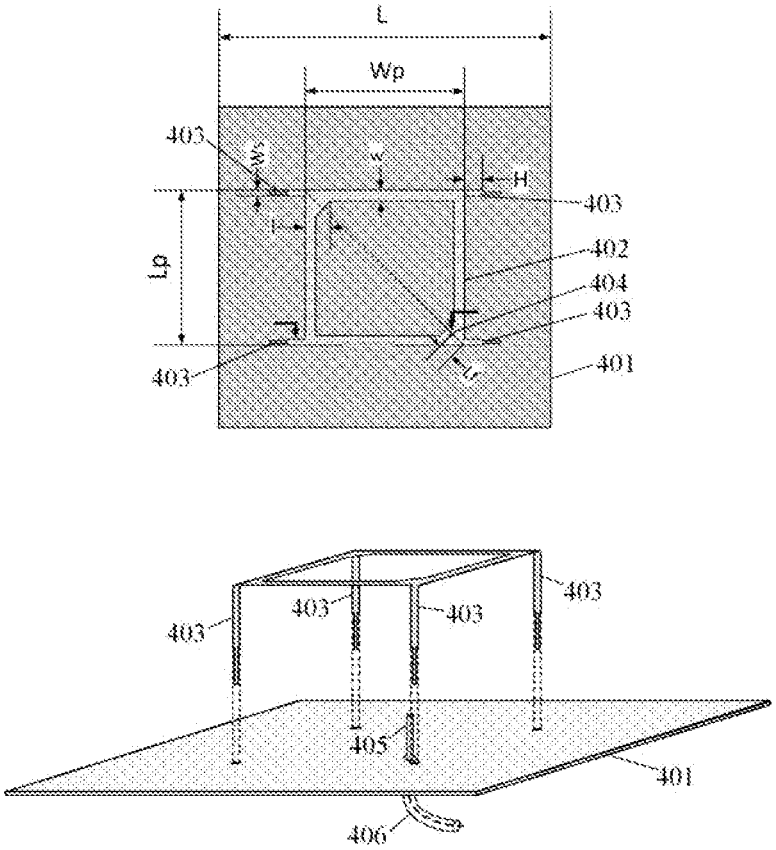
FIG. 6 illustrates a CP antenna according to an embodiment of the present application.

FIG. 6 illustrates a CP antenna according to an embodiment of the present application. As compared with the CP antenna of Embodiment I, the ground 401 and the legs 403 in Embodiment IV are similar with the ground 101 and the legs 103 in Embodiment I, but the CP antenna according to the Embodiment IV as shown in FIG. 6 has a patch 402 with a shape of a rectangular ring or "boxing-ring". In the antenna proposed according to this embodiment, two isosceles triangular corners are inserted on a diagonal line of the patch respectively so that two miter corners of the patch are formed. The feeding structure such as a probe 405 connected with a cable 406 is arranged to feed the patch along the diagonal line at a position 404 in or close to one of the two miter corners. The "boxing-ring" CP antenna has advantages of light weight and small footprint.

The "boxing-ring" antenna is made of metal. Comparing with the TAP CP antenna proposed in Embodiment I, the top rectangular patch of Embodiment I is replaced by a metallic rectangular ring, of which the length and width are Lp and Wp, respectively, and the width of the ring is W. Four metallic legs on the corners are inherent parts of the antenna and can be used to support the ring in the air. The length and width of the short pins are H and Ws, respectively. The feeding position of the antenna is distributed along the diagonal line of the rectangular ring and Lf distance away from one of the metallic legs. Two isosceles triangular metal corners can be inserted to the miter corners on the diagonal line for impedance matching and axial ratio tuning.

Figure 7A:
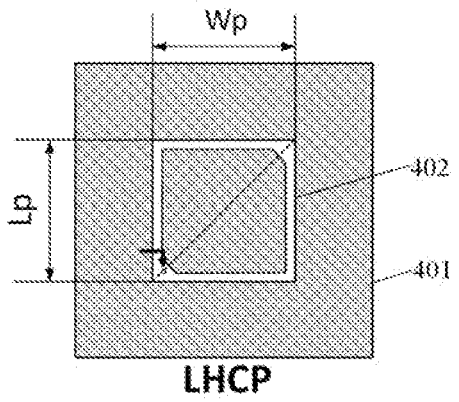
FIGS. 7(*a*) and 7(*b*) show feeding arrangements for right-hand (RHCP) and left-hand (LHCP) configurations of the antenna of FIG. 6.
Figure 7B:
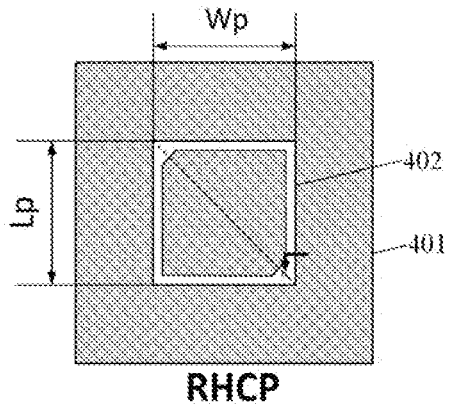

FIGS. 7(*a*) and 7(*b*) show the feeding arrangement of a LHCP antenna and a RHCP antenna of the "boxing-ring" antenna, respectively. The difference between the LHCP and RHCP antenna is that the feeding probes are located on the corresponding location along the different diagonals of the 'boxing-ring', where Lp should be larger than Wp. The feeding positions in the LHCP and RHCP 'boxing-ring' CP antennas are indicated by arrows in FIGS. 7(*a*) and 7(*b*), respectively.

The dimensions of the antenna can be designed based on simulations with EM software. Specific dimensions of the antenna may be adjusted so that one or more desired parameters, such as the reflection coefficient, peak gain and axial ratio, are obtained.

For example, a boxing-ring CP antenna with the physical dimensions listed in Table IV shows good performance.

TABLE IV

| | L | $L_p$ | $W_p$ | H | $W_s$ | Lf | W | l |
|---|---|---|---|---|---|---|---|---|
| mm | 200 | 55 | 52 | 9 | 1 | 3.53 | 3 | 4 |
| $\lambda_o$ | 1.633 | 0.449 | 0.424 | 0.073 | 0.008 | 0.029 | 0.024 | 0.033 |

Figure 22:
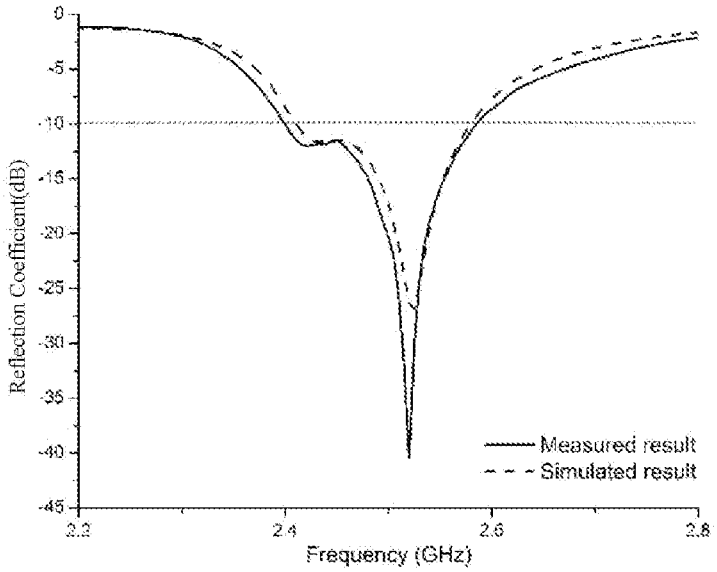
FIG. 22 illustrates the simulated and measured reflection coefficients of a 'boxing-ring' CP antenna according to the fourth embodiment.
Figure 23:
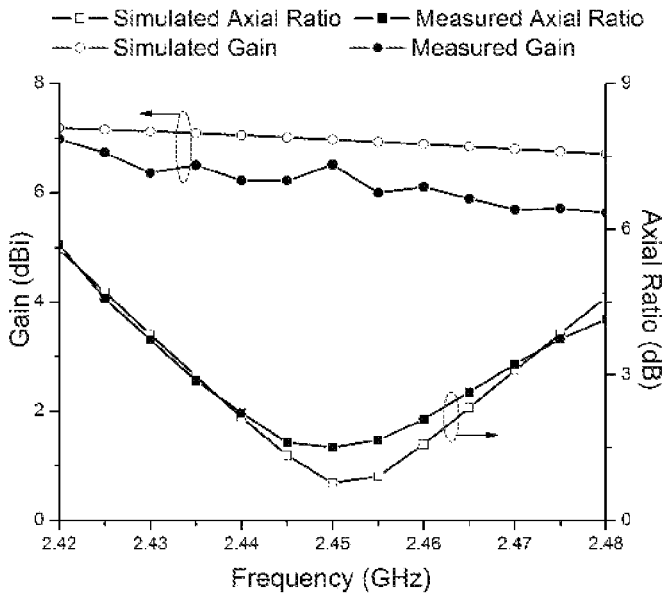
FIG. 23 illustrates the simulated gain and axial ratio comparing with the measured results of the 'boxing-ring' CP antenna according to the fourth embodiment.
Figure 24:
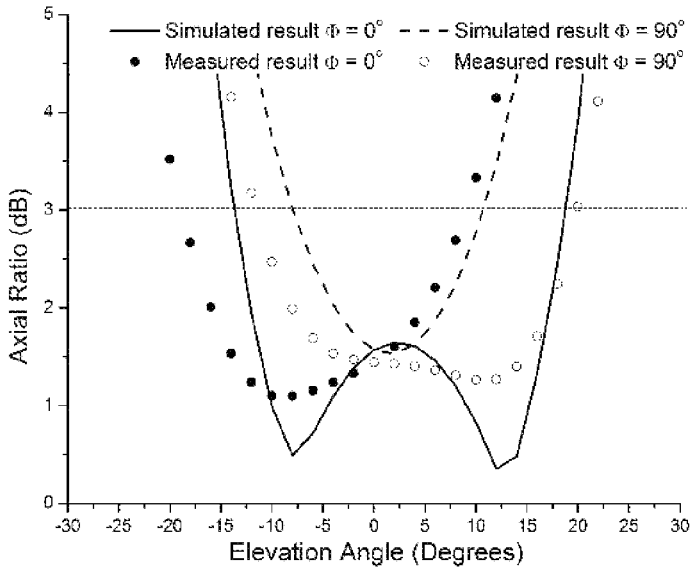
FIG. 24 illustrates the axial ratio versus elevation angles measured at 2.45 GHz according to the fourth embodiment.
Figure 25A:
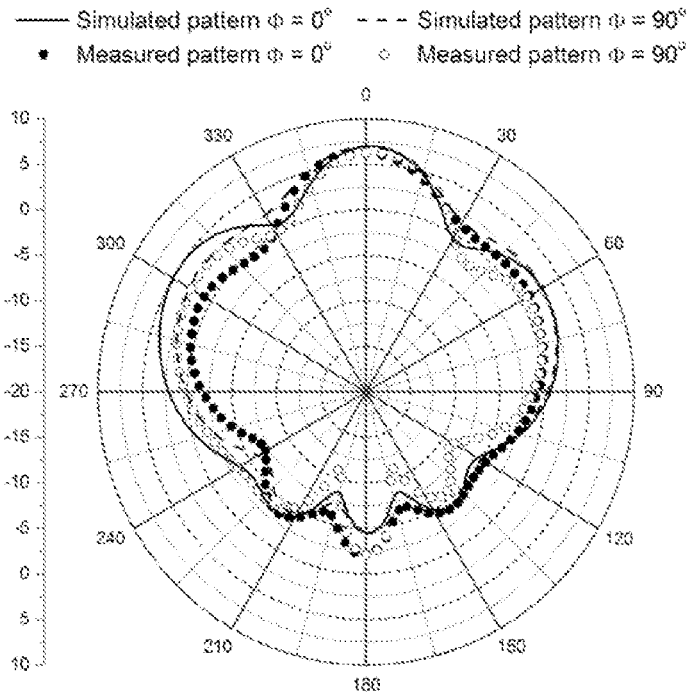
FIGS. 25 (*a*), 25(*b*) and 25(*c*) illustrate radiation patterns of the RHCP 'boxing-ring' CP antenna at 2.45 GHz according to the fourth embodiment.
Figure 25B:
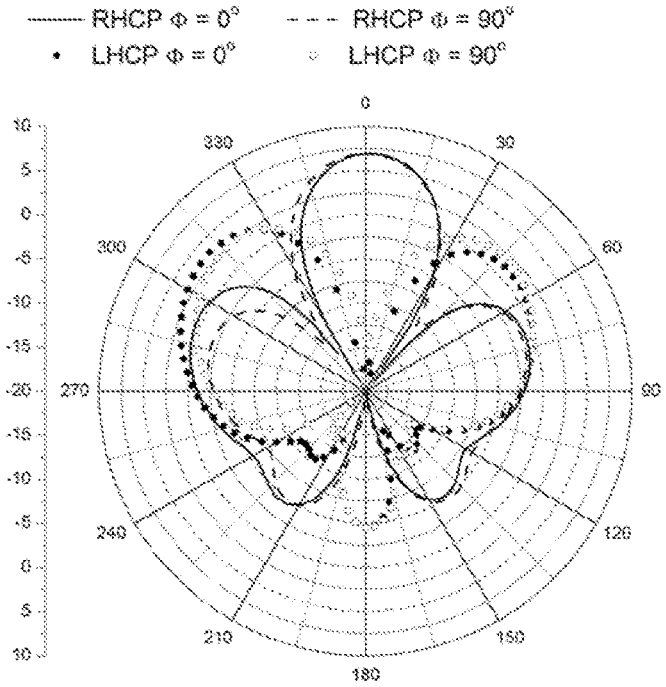
Figure 25C:
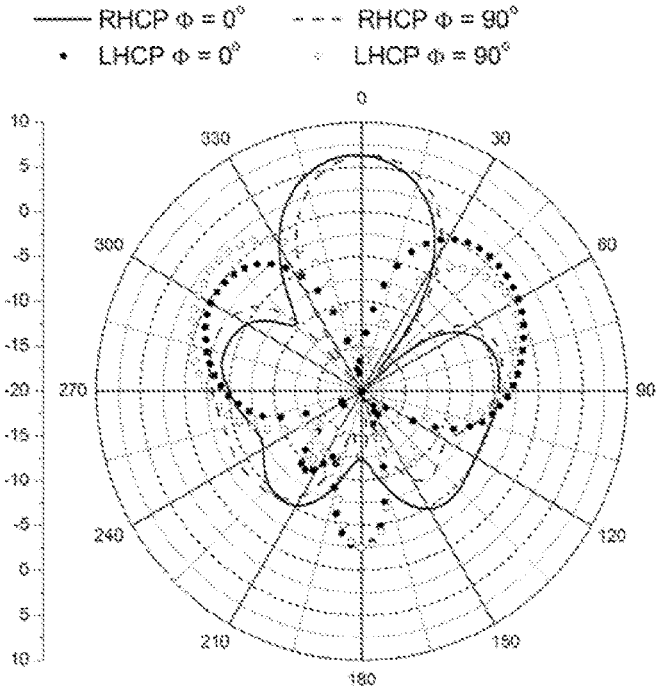

FIG. 22 illustrates the simulated and measured reflection coefficients of a 'boxing-ring' CP antenna according to the embodiment with the above parameters. FIG. 23 illustrates the simulated gain and axial ratio comparing with the measured results of the 'boxing-ring' CP antenna. FIG. 24 illustrates the axial ratio versus elevation angles measured at 2.45 GHz. FIGS. 25(*a*), 25(*b*) and 25(*c*) illustrate radiation patterns of the RHCP 'boxing-ring' CP antenna at 2.45 GHz, wherein FIG. 25(*a*) shows the total gain, FIG. 25(*b*) shows the simulated results for RHCP and LHCP patterns, and FIG. 25(*c*) shows the measured results for RHCP and LHCP patterns.

Embodiment V

Figure 8:
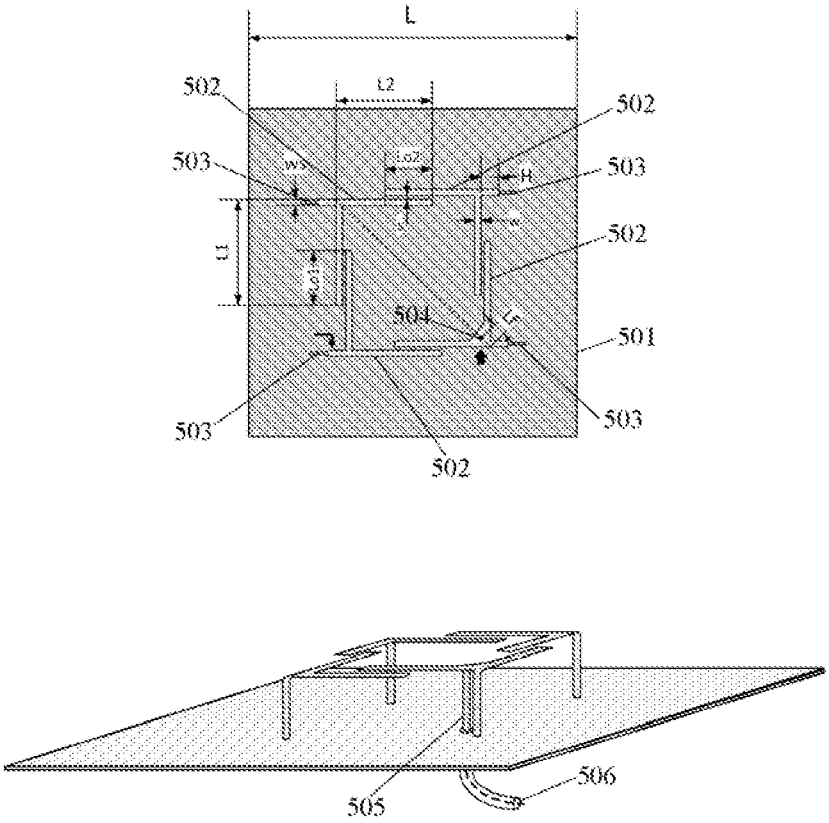
FIG. 8 illustrates a CP antenna according to an embodiment of the present application.

FIG. 8 illustrates a CP antenna according to an embodiment of the present application. As compared with the CP antenna of Embodiment IV which has a continuous rectangular ring, the antenna proposed in Embodiment V has a rectangular ring formed by four L-shaped strips 502, each two of which are partially overlapped two by two to form a side of the ring. An isosceles triangular corner is inserted on a diagonal line of the patch so that a miter corner is formed in one of the L-shaped strips. The feeding structure is arranged along the diagonal line at a position in or close to the miter corner. The ground 501, legs 503, feeding position 504, feeding structure 505 and cable 506 shown in FIG. 8 are similar with the ground 401, legs 403, feeding position 404, feeding structure 405 and cable 406 shown in FIG. 6.

The proposed antenna consists of a rectangular 'boxing-ring' shape loop and four metallic legs in the corners of the rectangular loop. Each edge is composed of two capacitively coupled strips with lengths of L1 and L2. The width of the strip is W. The overlaps of the two strips with are Lo1 and Lo2, respectively. The gap size of the overlapped strips is s. The operation frequency of the proposed antenna is dominated by the dimensions of L1, L2, Lo1 and Lo2. Four shorting legs with the height of H and thin width of Ws provide reliable mechanism to support the segmented loop. The feeding point is located along the diagonal of the rectangular loop with the distance of Lf away from a leg. With a capacitively coupled loop structure, the radiation gain of the proposed antenna may be modified by changing the dimensions of the loop, while the operation frequency does not change.

Figure 9A:
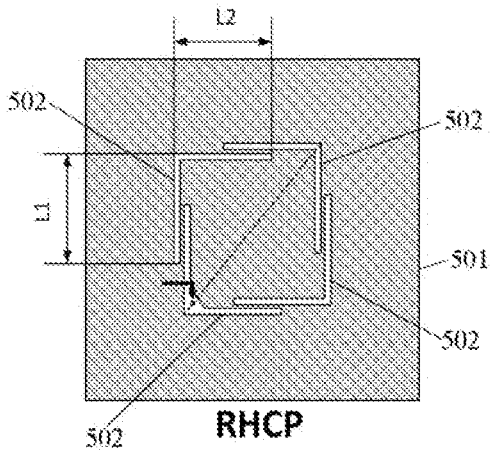
FIGS. 9(*a*) and 9(*b*) show feeding arrangements for right-hand (RHCP) and left-hand (LHCP) configurations of the antenna of FIG. 8.
Figure 9B:
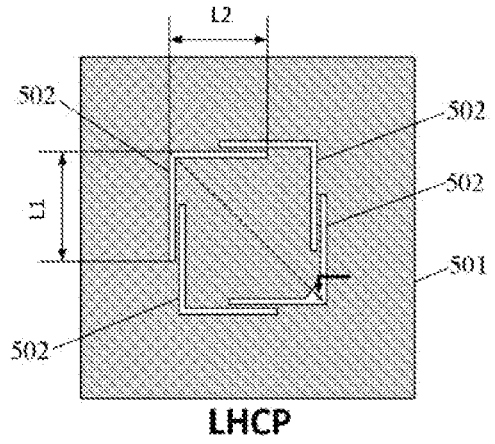

FIGS. 9(*a*) and 9(*b*) show the LHCP and RHCP capacitively coupled 'boxing-ring' CP antennas. The difference between the LHCP and RHCP antennas is that the corresponding feeding point is located on the different diagonals of the rectangular loop. The feeding positions in the RHCP and LHCP 'boxing-ring' CP antennas are indicated by arrows in FIGS. 9(*a*) and 9(*b*), respectively The dimensions of the antenna can be designed based on simulations with EM software. Specific dimensions of the antenna may be adjusted so that one or more desired parameters, such as the reflection coefficient, peak gain and axial ratio, are obtained.

For example, two boxing-ring TAP CP antennas, namely Ant_1 and Ant_2, according to Embodiment V with the physical dimensions listed in Table V shows good performance.

TABLE V

| | L | $L_1$ | $L_2$ | Lf | $L_{o1}$ | $L_{o2}$ | H | $W_s$ | s |
|---|---|---|---|---|---|---|---|---|---|
| Ant_1 | | | | | | | | | |
| mm | 200 | 34 | 33 | 4.26 | 16 | 16 | 9 | 1 | 1 |
| $\lambda_o$ | 1.633 | 0.278 | 0.269 | 0.035 | 0.13 | 0.13 | 0.073 | 0.008 | 0.008 |
| Ant_2 | | | | | | | | | |
| mm | 200 | 30 | 30 | 4.97 | 3 | 3 | 9 | 1 | 1 |
| $\lambda_o$ | 1.633 | 0.245 | 0.245 | 0.04 | 0.024 | 0.024 | 0.073 | 0.008 | 0.008 |

Figure 26A:
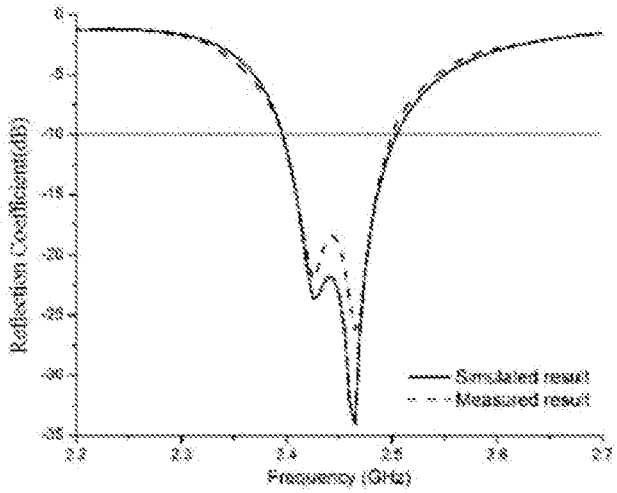
FIGS. 26(*a*) and 26(*b*) illustrate the simulated and measured reflection coefficients of Ant_1 and Ant_2, respectively, according to the fifth embodiment.
Figure 26B:
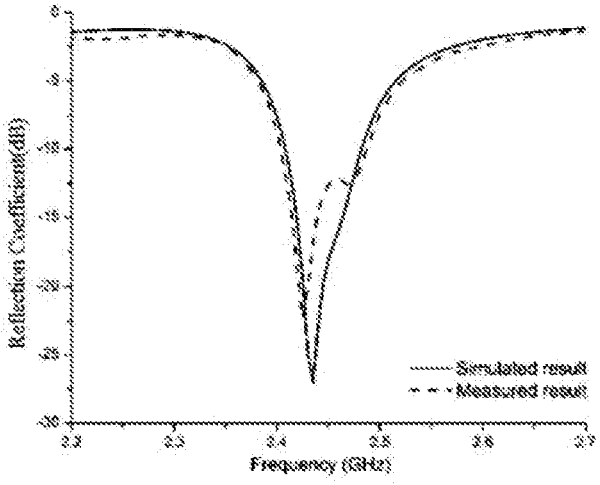
Figure 27A:
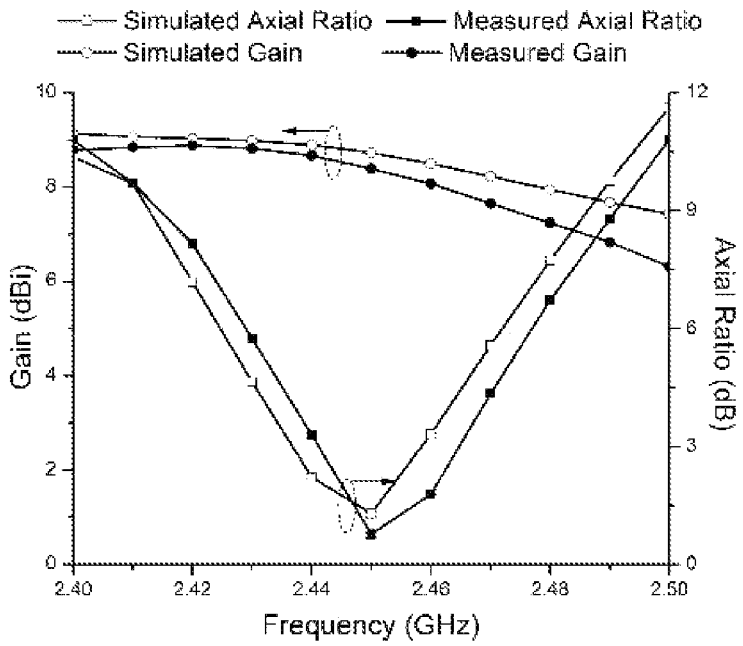
FIGS. 27(*a*) and 27(*b*) illustrate the simulated gain and axial ratio comparing with the measured results of Ant_1 and Ant_2, respectively, according to the fifth embodiment.
Figure 27B:
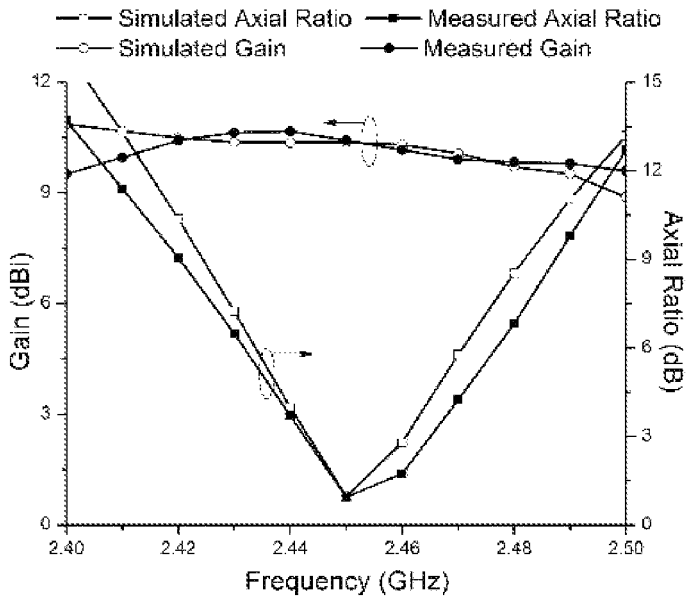
Figure 28A:
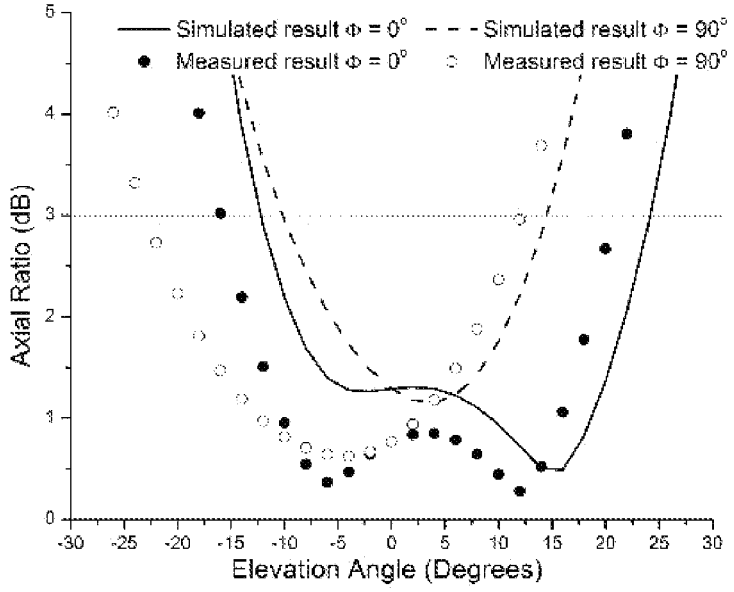
FIGS. 28(*a*) and 28(*b*) illustrate the axial ratio versus elevation angles of Ant_1 and Ant_2 measured at 2.45 GHz, respectively, according to the fifth embodiment.
Figure 28B:
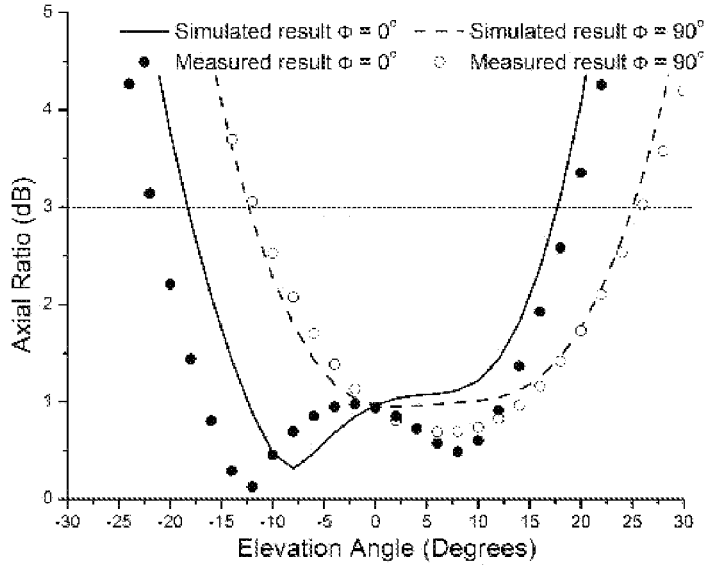
Figure 29A:
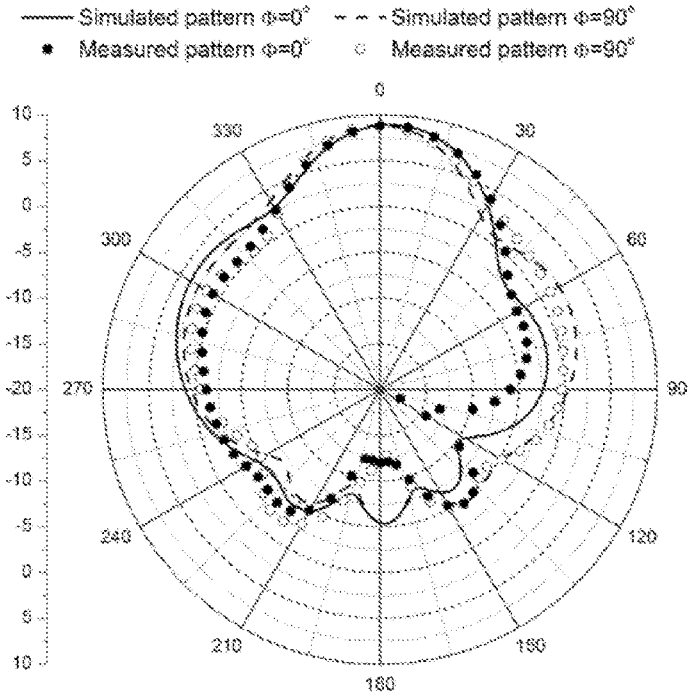
FIGS. 29(*a*) and 29(*b*) illustrate the radiation patterns of the capacitive loaded 'boxing-ring' CP antenna of Ant_1 and Ant_2 at 2.45 GHz, respectively, according to the fifth embodiment.
Figure 29B:
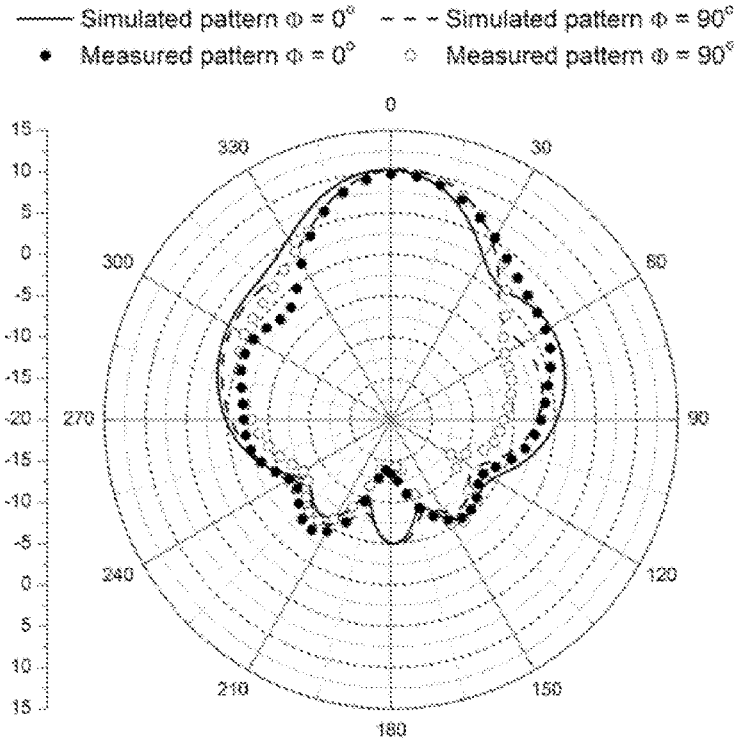
Figure 30A:
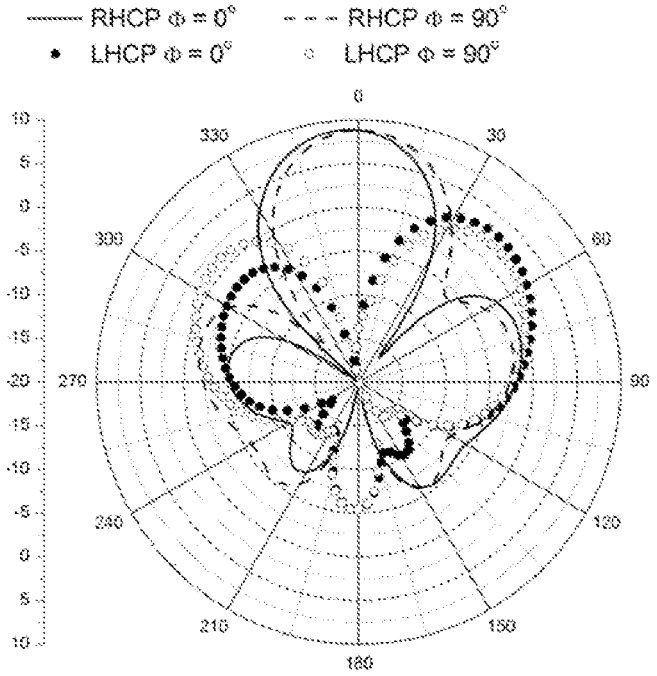
FIG. 30(*a*) illustrates the simulated RHCP and LHCP radiation patterns of Ant_1 at 2.45 GHz, and FIG. 30(*b*) illustrates the measured RHCP and LHCP radiation patterns of Ant_1 at 2.45 GHz according to the fifth embodiment.
Figure 30B:
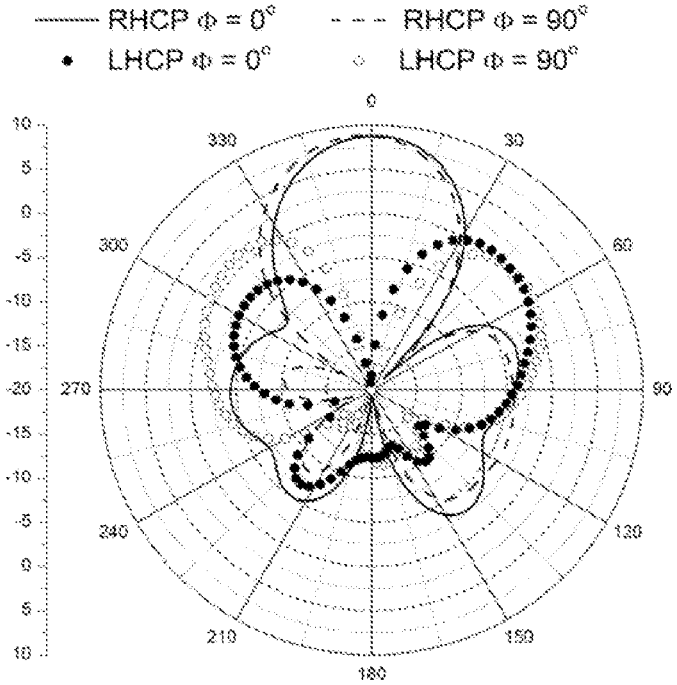
Figure 31A:
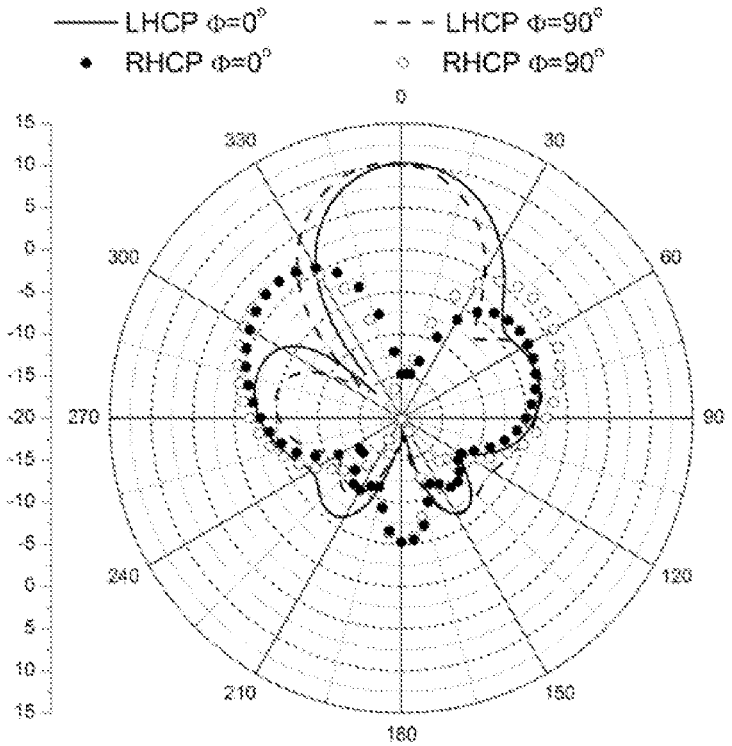
FIG. 31(*a*) illustrates the simulated RHCP and LHCP radiation patterns of Ant_2 at 2.45 GHz, and FIG. 31(*b*) illustrates the measured RHCP and LHCP radiation patterns of Ant_2 at 2.45 GHz according to the fifth embodiment.
Figure 31B:
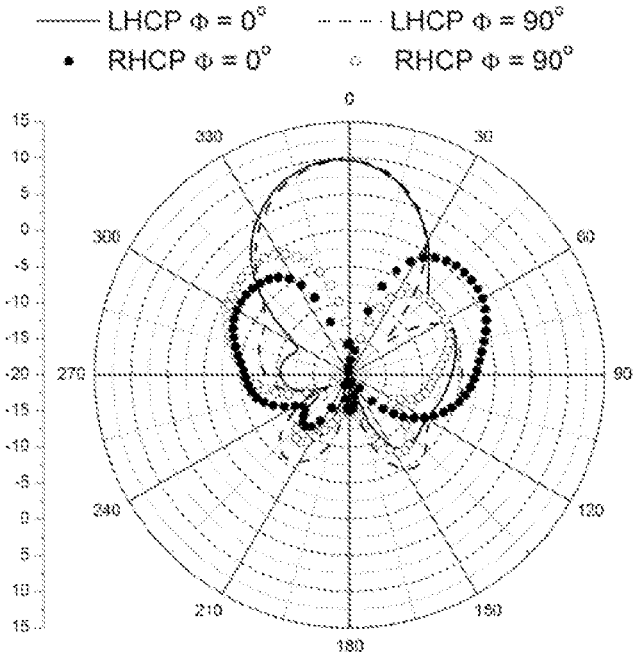

FIGS. 26(*a*) and 26(*b*) illustrate simulated and measured reflection coefficients of Ant_1 and Ant_2, respectively. FIGS. 27(*a*) and 27(*b*) illustrate the simulated gain and axial ratio comparing with the measured results of Ant_1 and Ant_2, respectively. FIGS. 28(*a*) and 28(*b*) illustrate the axial ratio versus elevation angles of Ant_1 and Ant_2 measured at 2.45 GHz, respectively. FIGS. 29(*a*) and 29(*b*) illustrate the radiation patterns of the capacitive coupled 'boxing-ring' CP antenna of Ant_1 and Ant_2 at 2.45 GHz, respectively. FIG. 30(*a*) illustrates the simulated RHCP and LHCP radiation patterns of Ant_1 at 2.45 GHz, and FIG. 30(*b*) illustrates the measured RHCP and LHCP radiation patterns of Ant_1 at 2.45 GHz. FIG. 31(*a*) illustrates the simulated RHCP and LHCP radiation patterns of Ant_2 at 2.45 GHz, and FIG. 31*b* illustrates the measured RHCP and LHCP radiation patterns of Ant_2 at 2.45 GHz.

Embodiment VI

Figure 32A:
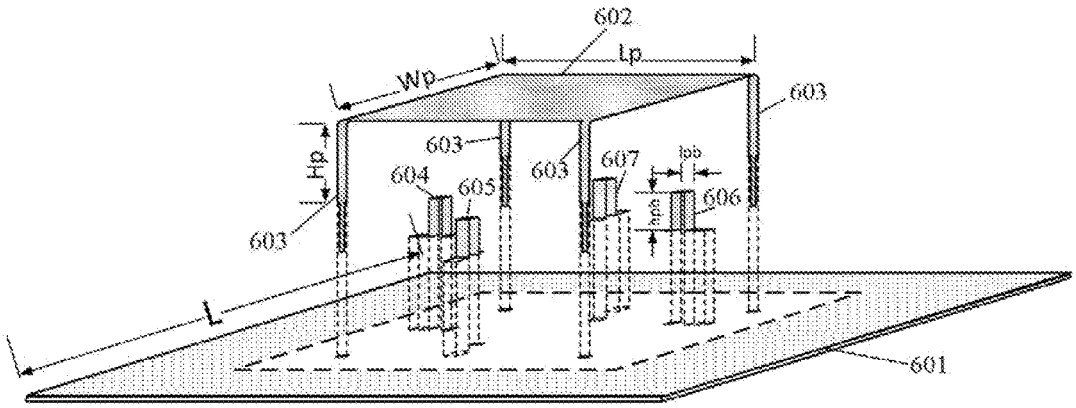
FIG. 32(*a*) illustrates a dual polarized antenna according to an embodiment of the present application.
Figure 32B:
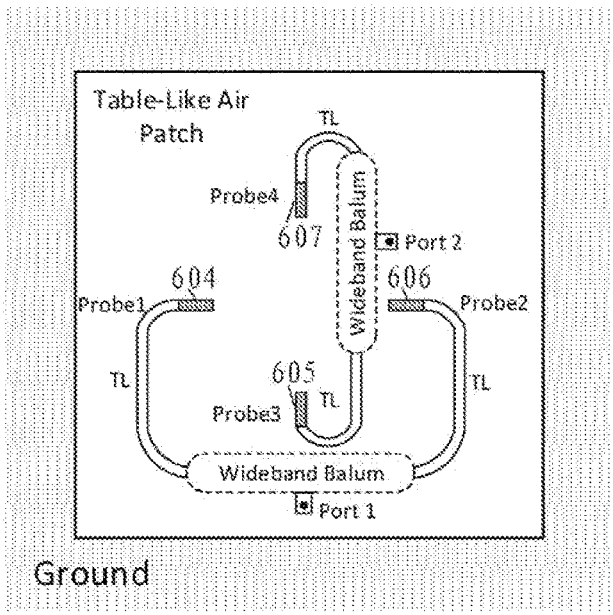

FIG. 32(*a*) illustrate a wideband dual polarized antenna according to an embodiment of the present application. As compared to the CP antenna proposed in Embodiment III, a different feeding network is used in the antenna proposed in Embodiment VI, which includes two sets of feeding structure. As shown, probes 604 and 606 construct a first feeding structure, while probes 605 and 607 construct a second feeding structure. In particular, FIG. 32(*a*) shows the configuration of the wideband TAP dual polarized antenna; FIG. 32(*b*) shows the feeding structure of the antenna. The ground 601, patch 602 and legs 603 in this embodiment are similar with the ground 301, patch 302 and legs 303 shown in Embodiment III.

As shown, the feeding structure comprises two baluns located on the grounded substrate for equally dividing an input signal into two equal magnitude but 180 degree phase difference signals, four transmission lines each of which has an end connected to a n n-shaped probe and the other end connected to one of the two ports of a balun, and four n-shaped probes each of which has an end connected to one of the four transmission lines and has its other end vertically connected to a soldering pad on the substrate.

Embodiment VII

Figure 33A:
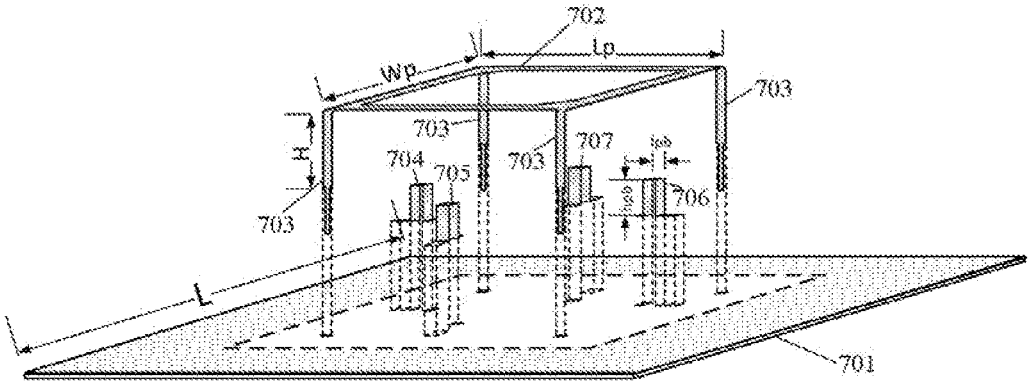
FIG. 33(*a*) illustrates a dual polarized antenna according to an embodiment of the present application.
Figure 33B:
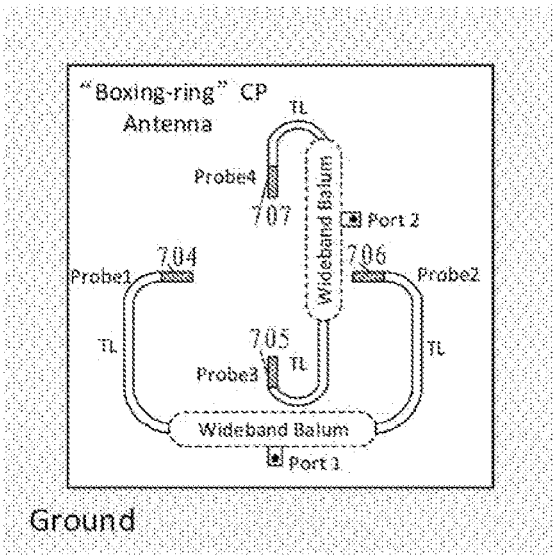

FIGS. 33(*a*) and 33(*b*) illustrate a 'boxing-ring' dual polarized antenna according to an embodiment of the present application. As compared to the CP antenna proposed in Embodiment IV, a different feeding network is used in the antenna proposed in Embodiment VII, which includes two sets of feeding structure. As shown, probes 704 and 706 construct a first feeding structure, while probes 705 and 707 construct a second feeding structure. In particular, FIG. 33(*a*) shows the configuration of the 'boxing-ring' dual polarized antenna; FIG. 33(*b*) shows the feeding structure of the antenna. The ground 701, patch 702 and legs 703 in this embodiment are similar with the ground 401, patch 402 and legs 403 shown in Embodiment IV.

As shown, the feeding structure comprises two baluns located on the grounded substrate for equally dividing an input signal into two equal magnitude but 180 degree phase difference signals, four transmission lines each of which has an end connected to an n-shaped probe and the other end connected to one of the two ports of a balun, and four n-shaped probes each of which has an end connected to one of the four transmission lines and has its other end vertically connected to a soldering pad on the substrate.

Although the preferred embodiments of the present invention have been described, many modifications and changes may be possible once those skilled in the art get to know some basic inventive concepts. The appended claims are intended to be construed comprising these preferred embodiments and all the changes and modifications fallen within the scope of the present invention.

It will be apparent to those skilled in the art that various modifications and variations could be made to the present application without departing from the spirit and scope of the present invention. Thus, if any modifications and variations lie within the spirit and principle of the present application, the present invention is intended to include these modifications and variations.

The invention claimed is:

1. An air-filled patch antenna, comprising:
a ground plane;
a patch arranged to be in parallel to the ground plane;
four inherent metal legs extending from the patch perpendicularly, wherein each of distal ends of the four legs is electrically and mechanically connected to the ground plane; and
a feeding structure configured to provide a signal interface to the antenna, wherein the feeding structure comprises a power divider located on the ground plane, two transmission lines connected to and extending from the power divider, and two n-shaped probes each of which has an end connected to one of the two transmission lines and another end soldered to a non-grounded soldering pad on the ground plane.

2. The antenna of claim 1, wherein the patch is in rectangular shape and the feeding structure is arranged at a feeding position along a diagonal line of the patch.

3. The antenna of claim 2, wherein the feeding position is close to one of the legs.

4. The antenna of claim 1, wherein the feeding structure is a probe.

5. The antenna of claim 1, wherein the patch is made of a piece of a metal sheet.

6. The antenna of claim 2, wherein a cross-shaped slot is cut through the patch, an intersection of the slot is located in the center of the patch, and two lines of the slot are in parallel to the two adjacent sides of the patch respectively.

7. The antenna of claim 6, wherein a distance from the feeding point to each of the two sides of the patch is smaller than a distance from each of the two lines of the slot to the corresponding side of the patch.

8. The antenna of claim 2, wherein the two transmission lines have a phase difference of 90 degrees.

9. The antenna of claim 1, wherein the patch is in a shape of a rectangular ring.

10. The antenna of claim 9, wherein two isosceles triangular corners are inserted on a diagonal line of the patch respectively so that two miter corners of the patch are formed.

11. The antenna of claim 10, wherein the feeding structure is arranged along the diagonal line at a position close to one of the two miter corners.

12. The antenna of claim 9, wherein the rectangular ring is continuous.

13. The antenna of claim 9, wherein the rectangular ring is formed by four L-shaped strips, each two of which are partially overlapped to form a side of the ring.

14. The antenna of claim 13, wherein an isosceles triangular corner is inserted on a diagonal line of the patch so that a miter corner is formed in one of the L-shaped strips.

15. The antenna of claim 14, wherein the feeding structure is arranged along the diagonal line at a position close to one of the two miter corners.

* * * * *